US005408252A

United States Patent [19]

Oki et al.

[11] Patent Number: 5,408,252

[45] Date of Patent: Apr. 18, 1995

[54] ACTIVE MATRIX-TYPE DISPLAY DEVICE HAVING A REDUCED NUMBER OF DATA BUS LINES AND GENERATING NO SHIFT VOLTAGE

[75] Inventors: Ken-ichi Oki; Ken-ichi Yanai, both of Kawasaki, Japan

[73] Assignee: Fujitsu Limited, Kawasaki, Japan

[21] Appl. No.: 241,674

[22] Filed: May 12, 1994

Related U.S. Application Data

[63] Continuation of Ser. No. 952,646, Sep. 28, 1992, abandoned.

[30] Foreign Application Priority Data

Oct. 5, 1991 [JP] Japan ..... 3-258198
Jul. 9, 1992 [JP] Japan ..... 4-182264

[51] Int. Cl.[6] ..... G09G 3/36

[52] U.S. Cl. ..... 345/205; 345/98; 359/57

[58] Field of Search ..... 340/784, 703; 345/87, 345/90, 92, 96, 98, 103, 205, 206; 359/59, 57, 60, 88

[56] References Cited

U.S. PATENT DOCUMENTS

| | | | |
|---|---|---|---|
| 4,678,282 | 7/1987 | Yaniv et al. | 350/334 |
| 4,694,287 | 9/1987 | Chenevas-Paule et al. | 340/719 |
| 4,717,244 | 1/1988 | Hilsum et al. | 350/333 |
| 4,740,782 | 4/1988 | Aoki et al. | 340/784 |
| 4,775,861 | 10/1988 | Saito | 340/784 |
| 4,890,097 | 12/1989 | Yamashita et al. | 340/784 |
| 5,095,304 | 3/1992 | Young | 340/784 |
| 5,132,677 | 7/1992 | Nicholas | 359/59 |
| 5,151,689 | 9/1992 | Kabuto et al. | 340/784 |

FOREIGN PATENT DOCUMENTS

| | | |
|---|---|---|
| 53-144297 | 12/1978 | Japan . |
| 62-218987 | 9/1987 | Japan . |
| 63-96636 | 4/1988 | Japan . |
| 2-135318 | 5/1990 | Japan . |
| 2-214819 | 8/1990 | Japan . |
| 3-38689 | 2/1991 | Japan . |
| 4-14091 | 1/1992 | Japan . |
| 4-14092 | 1/1992 | Japan . |
| 4-102825 | 4/1992 | Japan . |

*Primary Examiner*—Ulysses Weldon
*Assistant Examiner*—Gin Goon
*Attorney, Agent, or Firm*—Staas & Halsey

[57] ABSTRACT

In an active matrix-type display device, two pixel electrodes of cells neighboring in the direction of scan bus lines are connected to the same data bus line, and these two cells are independently controlled by the time division technique. When an address pulse is applied to the scan bus line for accessing each cell of the pixel rows, a compensation pulse is applied to the scan bus line arranged on the other side of the pixel row.

21 Claims, 20 Drawing Sheets t0 t1 t2 t3 t4 t10 t11 t12

+VGN
SCm,1
-VGP

SCm,2

SCm+1,1

SCm+1,2
SDn

+VDB
+VDD
0
-VDD
-VDB

VLCm,2n-1
VLCm,2n

EVEN FRAME
ODD FRAME

SCm,1
+VGN
-VGP

SCm,2
+VGN
-VGP

SCm+1,1
+VGN
-VGP

SCm+1,2
+VGN
-VGP

SCm+2,1
+VGN
-VGP

VLCm,2n-1
+VDB
0V
-VDB t-2 t-1 to t1 t2
SDn

ADDRESS PULSE
SCm

COMPENSATION PULSE

SCm+1
COMPENSATION PULSE

VLCm,2n-1
VLCm-1,2n (-)
VLCm,2n
VLCm-1,2n-1 (+)

t0 t1 t2
t10 t11 t12
SCm,1
SCm,2
SDn
+VR
+VD
-VD
-VR
VLCm,2n-1
VLCm,2n t0 t1 t2
t10 t11 t12

SCm,1

SCm,2

+VR
VD
-VR

VLCm,2n-1

VLCm,2n t-1 t0 t1 t2 t3
t1-1 t10 t11 t12

SCm,1

SCm,2

+VR
VR1

VR2
-VR

+VR
SDn
-VR

VLCm,2n-1

VLCm,2n

ACTIVE MATRIX-TYPE DISPLAY DEVICE HAVING A REDUCED NUMBER OF DATA BUS LINES AND GENERATING NO SHIFT VOLTAGE

This application is a continuation of application Ser. No. 07/952,646, filed Sep. 28, 1992, now abandoned.

BACKGROUND OF THE INVENTION

1. Field of the Invention

The present invention relates to an active matrix-type display device using an electro-optic material such as liquid crystal, and more particularly, to an active matrix-type display device having less data bus lines than those of a normal type.

2. Description of the Related Art

An active matrix-type display device as well as a simple matrix-type display device is thin, and therefore, is often used in various thin display devices of information terminals. Generally, liquid crystal is used as electro-optic material of this device. Compared to the simple matrix-type liquid crystal display device, in this active matrix-type liquid crystal display device, since individual pixel elements are independently driven, the contrast is not reduced based upon the reduction of duty ratio, and the angle of visibility is not reduced, even when the capacity of the display is increased to increase the number of lines. Therefore, the active matrix-type liquid crystal display device enables a color display in the same way as in a cathode ray tube (CRT), and is prevalent in flat display devices.

However, since the active matrix-type liquid crystal display device has a complex configuration and one thin film transistor (TFT) as a switching element is provided for each pixel, a complex manufacturing process is required, and equipment therefor is expensive. Also, the manufacturing yield is low. Further, in the active matrix-type liquid crystal display device, the number of driver ICs increases according to an increase in display abilities, thereby making the active matrix-type liquid crystal display device expensive. Therefore, in order to improve the low manufacturing yield, various types of active matrix-type liquid crystal display devices have been suggested.

One type is a counter-matrix active matrix-type liquid crystal device in which scan bus lines and data bus lines are formed on different substrates, so that intersections of scan bus lines and data bus lines on the same substrate are not used (see: U.S. Pat. Nos. 4,694,287, 4,717,244, 4,678,282).

In other types of devices disclosed in Japanese Unexamined Patent Publication Nos. 62-218987, 3-38689, two neighboring pixel elements are respectively connected to the same data bus line via two independently controlable TFTs, and are driven at time division sequences, thereby reducing the number of the data bus lines. Since the data bus driver is more complex than the scan bus driver, the driver configuration of this device is very simple. However, in the above documents, examples of the counter-matrix active matrix-type liquid crystal device in which the number of data bus lines is reduced are not disclosed.

Further, in the active matrix-type liquid crystal display device, improvement in display quality and duration are also desired. In any type of active matrix-type liquid crystal device, a DC component resulting from parasitic static capacitense and the unipolarity of the address pulses is generated. For example, flickers and residual images may be generated. Particularly, for a stationary image, a burning phenomenon may occur. Also, the life-time of active matrix-type liquid crystal devices may be shortened.

In the Japanese Unexamined Patent Publication No. 53-144297, the active matrix-type display device in which one pixel electrode is connected to two data bus lines via two switching elements is disclosed. The two switching elements are respectively controlled by positive and negative address pulses on the same scan bus line. Two positive and negative address pulses are applied for each scanning frame cycle on the scan bus line and two data signals having the same voltages and opposite polarities to each other are applied to the data bus lines in synchronization with the address pulses. By this, two different switching elements are effected individually for each frame cycle, and the influence of the parasitic static capacity is canceled. Therefore, in this device, the above-mentioned DC component can be reduced, and the above problems associated with display quality and the duration are improved. However, this device has a problem in that the number of data bus lines is increased.

Further, the Japanese Unexamined Patent Publication Nos. 63-96636, 2-212819, 4-14091, 4-14092 and 4-102825 disclosed active matrix-type display devices in which each pixel electrode is connected to the data bus line via two different switching elements respectively conducted by positive and negative address pulses, and these two switching elements are simultaneously or individually effected for each scanning frame, thereby canceling the influence of the parasitic static capacity, and the above problems are improved.

SUMMARY OF THE INVENTION

An object of the present invention is to improve the display quality in an active matrix-type display device in which the number of data bus lines is reduced.

According to the present invention, in an active matrix-type display device, two kinds of scan bus lines are provided in both sides of each row of pixel electrodes, and a pair of a first switching element, such as an N-channel thin film transistor and a second switching element such as a P-channel thin film transistor, are connected to each of the pixel electrodes, and each pair of pixel electrodes neighboring in a direction of the scan bus lines are connected to the same data bus line, and a first switching element connected to one pixel of the pair and a second switching element connected to the other pixel of the pair are connected to one scan bus line of the pair, and a second switching element connected to one pixel of the pair and a first switching element connected to the other pixel of the pair are connected to the other scan bus line of the pair. On both the first and second scan bus lines, compensating address pulses operating in each other are applied.

BRIEF DESCRIPTION OF THE DRAWINGS

The present invention will be more clearly understood from the description as set forth below with reference to the accompanying drawings, wherein.

DESCRIPTION OF THE PREFERRED EMBODIMENTS

Before the description of embodiments of the present invention, prior art of the liquid crystal display devices will be explained with reference to FIGS. 1 through 5.

Figure 1:
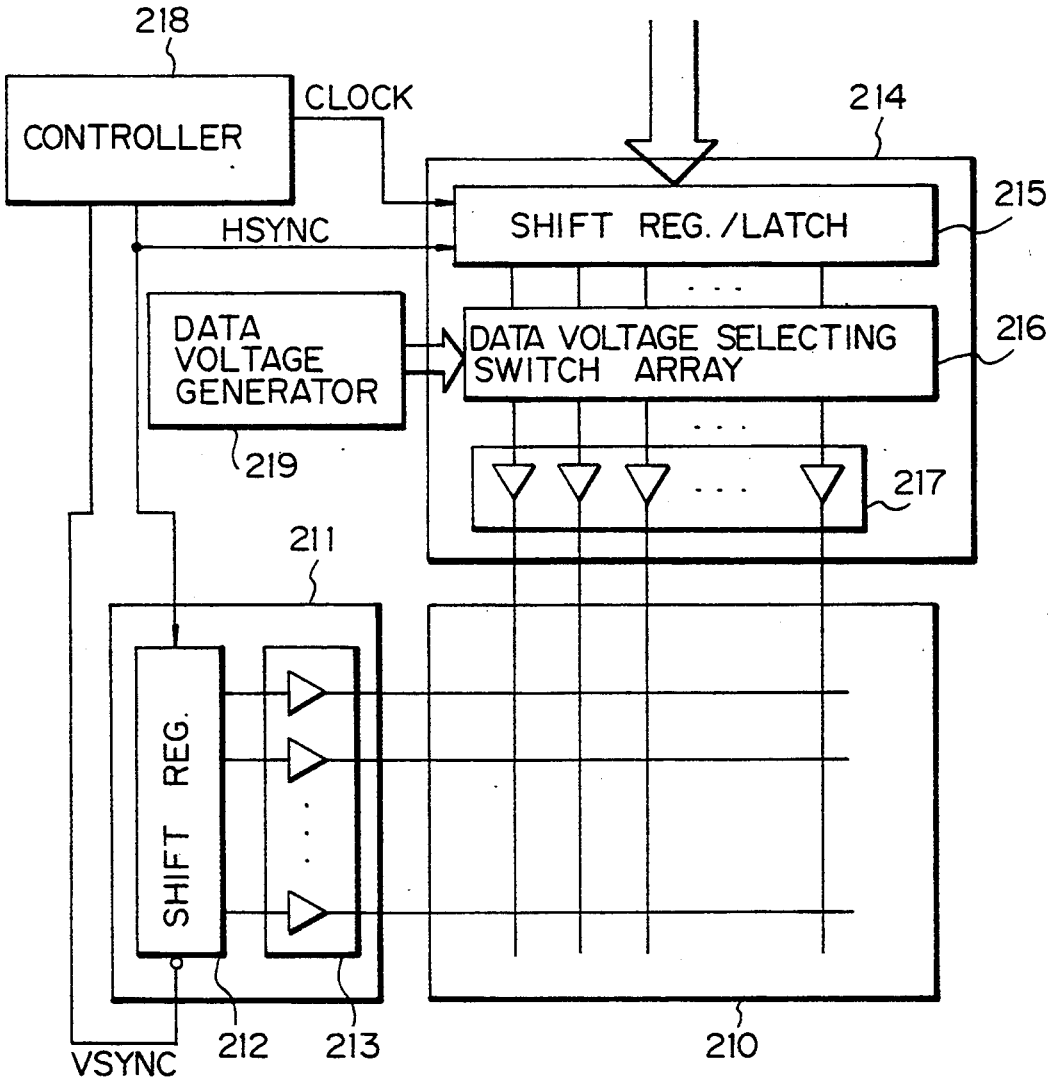
Fig. 1 PRIOR ART
FIG. 1 is a block circuit diagram illustrating a prior art liquid crystal display device including control portions.

In FIG. 1, which illustrates a general liquid crystal display device including control portions, reference numeral 210 designates a liquid crystal panel having a plurality of scan bus lines that are arranged parallel and a plurality of data bus lines that are arranged parallel to each other. A scan bus driver 211 applies address pulses to the scan bus lines and a data bus driver 214 applies displaying data signals to the data bus lines. The address pulses are sequentially and repeatedly applied from the top line to the bottom line of the scan bus lines, and this repeat cycle time is designated as a frame. In an interlace method, where the address pulses are applied on every other line, there are two frames of first and second frames, which are respectively designated as an odd frame and an even frame.

Reference numeral 218 designates a controller for generating control signals such as a clock signal, a horizontal scanning signal (HSYNC), a vertical synchronous signal (VSYNC). Reference numeral 219 designates a data voltage generator for generating data voltages that the data bus driver 214 applies to the data bus lines, and the data voltage generator 219 generates a plurality of voltages corresponding to gradation levels when gradation display is performed. Further, in the liquid crystal display device, two different data voltages having reverse polarities are required to be applied to each display cell for every frame, therefore, the data voltage generator 219 generates two kinds of gradation level data voltages.

The scan bus driver 211 provides a shift register 212 and an output circuit 213. The shift register 212 shifts a signal designating the position of the scan bus lines to which the address pulse is applied according to the HSYNC signal. The output circuit 213 is a driver circuit for outputting the address signal to each scan bus line according to the output signal from the shift register 212.

The data bus driver 212 provides a shift register/latch 215, a data voltage selecting switch array 216 and an output circuit 217. The shift register/latch 215 receives input display data in synchronization with the clock signal and shifts it, and when total data of one row is completed, latches it according to the HSYNC signal. The data voltage selecting switch array 216 selects the data voltage of each data bus line from the data voltages generator 219 according to the display data of one row output from the shift register/latch 215. The output circuit 217 is a driver circuit for outputting these data voltages of one row to the data bus lines.

Prior art liquid crystal display devices (display panels) are explained with reference to FIGS. 2 and 3.

Figure 2:
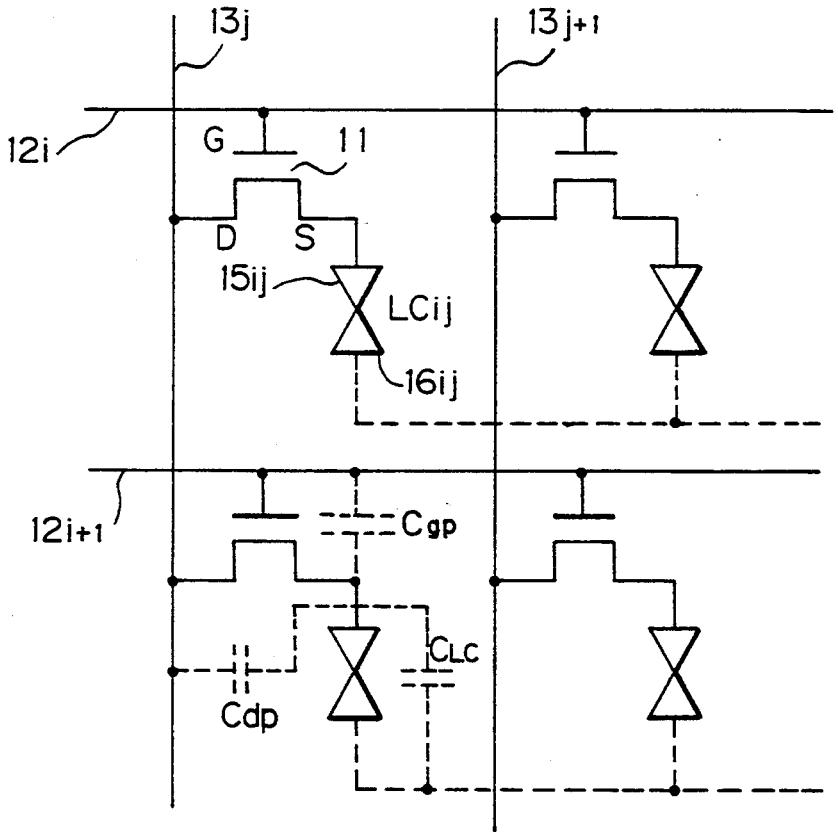
Fig. 2 PRIOR ART
FIG. 2 is an equivalent circuit diagram illustrating a prior art active matrix-type liquid crystal device.

As illustrated in an equivalent circuit in FIG. 2, scan bus lines $\mathbf{12}_i, \mathbf{12}_{i+1}, \ldots$ and data bus lines $\mathbf{13}_j, \mathbf{13}_{j+1}, \ldots$ are perpendicularly formed on one of the two glass substrates (not shown) having filled liquid crystal material therebetween; the substrate of which oppose each other. The scan bus lines $\mathbf{12}_i$, $\mathbf{12}_{i+1}, \ldots$ are electrically isolated from the data bus lines $\mathbf{13}_j, \mathbf{13}_{j+1}, \ldots$ at their intersections.

At one intersection of the scan bus line such as $\mathbf{12}_i$ and the data bus line such as $\mathbf{13}_j$, a thin film transistor $\mathbf{11}_{ij}$ is connected between the data bus line $\mathbf{13}_j$ and a pixel electrode $\mathbf{15}_{ij}$ of a liquid crystal cell $LC_{ij}$, and is controlled by a potential of the scan bus line $\mathbf{12}_i$. That is, the thin film transistor (TFT) $\mathbf{11}_{ij}$ has a drain D connected to the data bus line $\mathbf{13}_j$, a gate G connected to the scan bus line $\mathbf{12}_i$, and a source S connected to a pixel electrode $\mathbf{15}_{ij}$ of a liquid crystal cell $LC_{ij}$ whose electrode is grounded by the common electrode (not shown) on the other glass substrate (not shown).

The liquid crystal cells are driven as follows. By applying an address pulse to the scan bus line $\mathbf{12}_i$, all TFTs connected to the scan bus line $\mathbf{12}_i$ are turned ON, and the pixel electrode $\mathbf{15}_{ij}$ and the data bus line $\mathbf{13}_j$ are connected. Therefore, a potential difference between the data bus line and the counter pixel electrode 16 connected to the common reference voltage line is applied to the capacitor formed by the pixel electrodes, the counter pixel electrode 16 and the liquid crystal material therebetween, thereby charging the state of the liquid crystal. When the address pulse is not applied to the scan bus line 12, the TFT 11 is turned OFF, and then, the state of the liquid crystal is maintained until the next address pulse is applied.

In the above-mentioned active matrix-type liquid crystal display device of FIG. 2, since the scan bus lines $12_i$, $12_{i+1}$, . . . and the data bus lines $13_j$, $13_{j+1}$, . . . are formed and intersected on the same substrate, insulation defects or short-circuits may occur at the intersections, and also disconnections owing to a step wise configuration at the intersections may occur in the overlaying bus lines. Therefore, there is a limit in the overlaying layers between the overlaying and underlying bus lines. As a result, it is not easy to reduce the resistance of the underlying bus lines and increase the thickness of the insulating layers. Thus, it is difficult to completely avoid short-circuits at the intersections.

Figure 3:
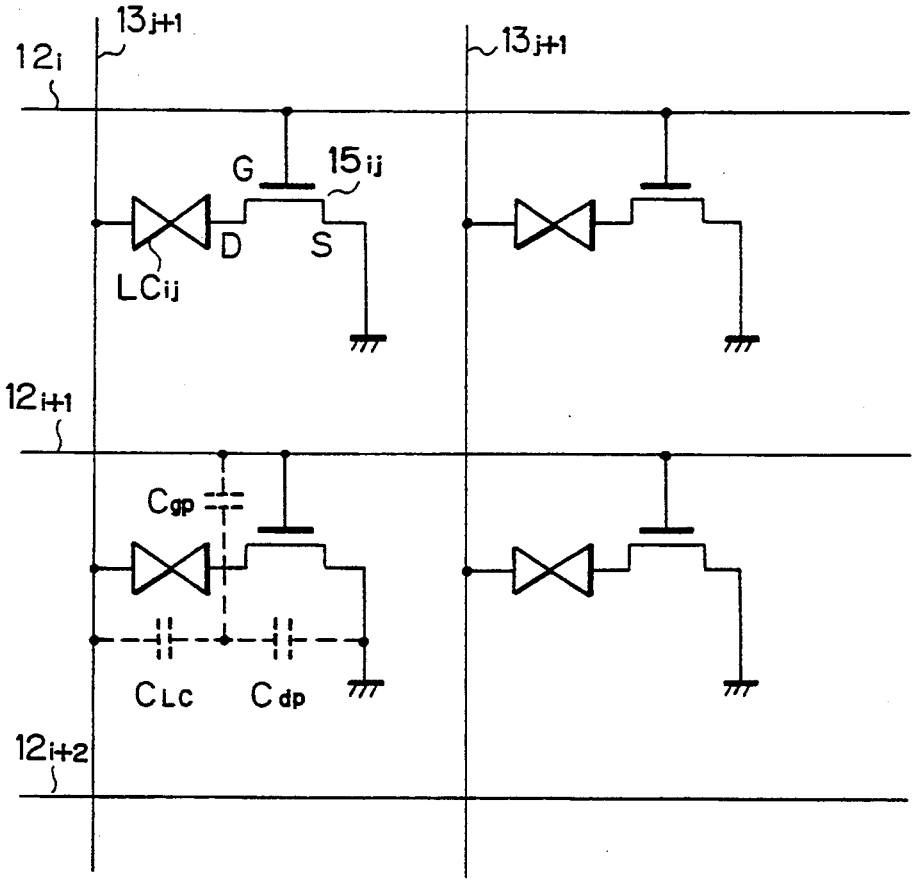
Fig. 3 PRIOR ART
FIG. 3 is an equivalent circuit diagram illustrating a prior art counter-matrix-type active matrix-type liquid crystal device.
Figure 4:
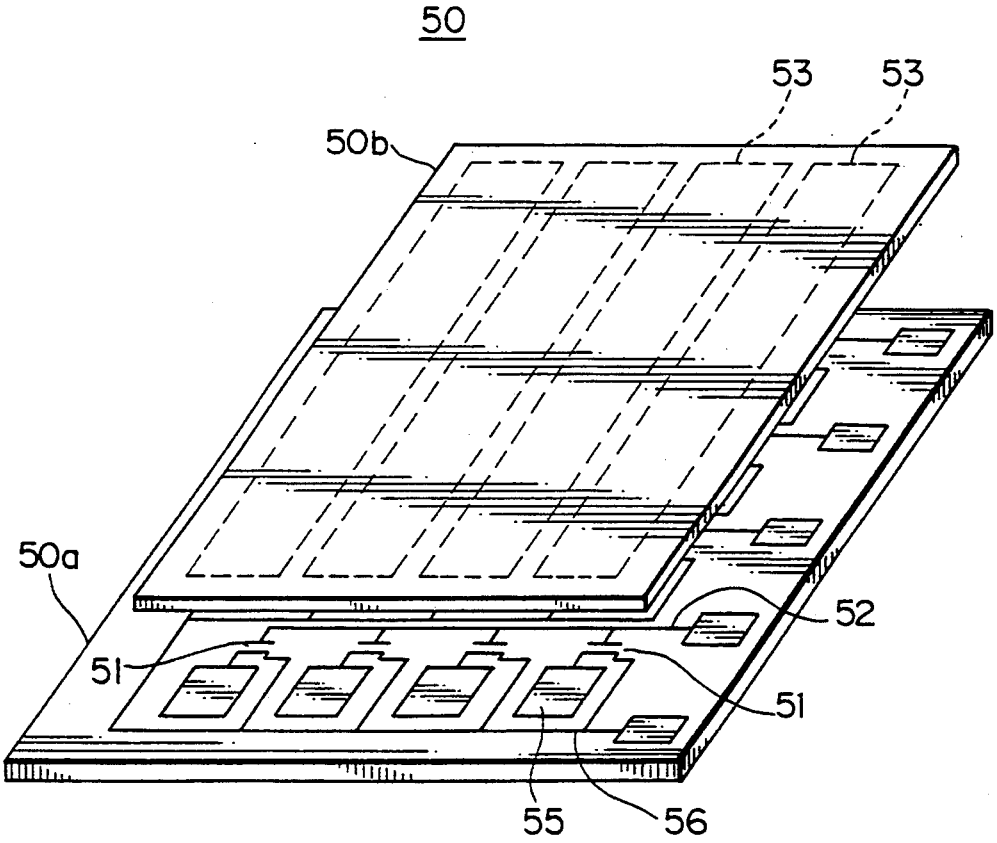
Fig. 4 PRIOR ART
FIG. 4 is an enlarged, perspective view of the device of FIG. 3.

Therefore, as illustrated in FIGS. 3 and 4, a counter-matrix-type active liquid crystal display device with scan bus lines 52 formed on one glass substrate 50*a* and data bus lines 53 formed on the other glass substrate 50*b* that opposes the first substrate 50*a* has been suggested (see: above-mentioned U.S. Pat. Nos. 4,694,287, 4,717,244, 4,678,282).

Note that FIG. 3 is an equivalent circuit diagram of a prior art counter matrix active liquid crystal display device, and FIG. 4 is its enlarged, perspective view.

That is, liquid crystal is filled between the glass substrates 50*a* and 50*b*. The stripped data bus lines are formed on the glass substrate 50*b*, while the scan bus lines, the thin film transistors such as 51, pixel electrodes such as 55 for forming liquid crystal cells, and reference voltage supply bus lines 56 (which are illustrated as the ground in FIG. 3) are formed on the glass substrate 50*a*.

Liquid crystal is filled between the data bus lines and the pixel electrodes to form the liquid crystal cells . For example, the liquid crystal cell $LC_{ij}$ is connected between the data bus line 53, and the drain D of the thin film transistor 51 whose gate G is connected to the scan bus line 52. Also, the source S of the thin film transistor 51 is connected to the reference voltage supply bus line 56.

In the above-mentioned configuration, of FIGS. 3 and 4, the scan bus lines $12_i$, $12_{i+1}$, . . . and the data bus lines $13_j$, $13_{j+1}$, . . . are orthogonal to each other and they sandwich the liquid crystal, so it is unnecessary to form insulating layers for the intersections since the two kinds of bus lines are not formed on the same substrate, thereby making the configuration simple. Also, since no short-circuit occurs between the data bus lines $13_j$, $13_{j+1}$, . . . and the scan bus lines $12_i$,$12_{i+1}$, . . . defects of display are reduced, thereby improving the manufacturing yield.

As described in the above, in any type of active matrix-type liquid crystal device, a DC component resulting from the parasitic static capacitense and the unipolarity of the address pulse is generated. This DC component reduces the quality of display, and shortens the life-time of the device.

In the active matrix-type liquid crystal device of FIG. 2, when the data voltage is written to the pixel electrode, the address pulse changes the potential of the scan bus line to a level at which the TFT is conducted, and the potential of the scan bus line returns to the base level. That is, if the TFT is an Nch-type transistor, the base level is a negative level such as −20 V and the pulse level is a positive level such as +20 V. In this way, the potential of the scan bus line is high when the data voltage is written, and the potential of the scan bus line is low when the written data voltage is maintained. Therefore, this voltage fluctuation of the scan bus line decreases the potential of the pixel electrode during the maintaining period and generates a DC level shift.

If $C_{gp}$ is a parasitic electrostatic capacitense between the scan bus line $12_i$ to which the gate G of the TFT $11_{ij}$ is connected and the pixel electrode $15_{ij}$.

$C_{dp}$ is a parasitic electrostatic capacitense between the pixel electrode and the data bus line $13_j$, i.e., a parasitic electrostatic capacitense between the source S and the drain D of the TFT $11_{ij}$, $C_{ic}$ is an electrostatic capacitense of the liquid crystal cell $LC_{ij}$, $\Delta V_{gn}$ is a fluctuation of the potential of the address pulse, then, the voltage of the DC level shift $\Delta V_{ic}$ is expressed by the following formula (1);

$$\Delta V_{ic}=(-C_{gp}\times\Delta V_{gn})/(C_{ic}+C_{gp}+C_{dp}) \quad (1)$$

The wave form of the driving signal of the liquid crystal is required to have no DC component. However, although the driving signal has a symmetric positive and negative wave form, the driving signal has an asymmetric wave form due to the above-mentioned shift. Consequently, the DC component is generated. This DC component reduces the life-time of the liquid crystal, and also generates a flicker and a residual image, thus reducing the quality of display.

To cope with this, a bias voltage is applied to the common electrode (ground) of the liquid crystal cell $LC_{ij}$, for example, to make the effective voltage of the liquid crystal cell $LC_{ij}$ symmetric for a positive frame and a negative frame, thus reducing the DC component. In this device, however, since the capacity of the liquid crystal cell has a voltage dependency due to the anisotropy of dielectric characteristics of the liquid crystal cell, the shift voltage $\Delta V_{ic}$ fluctuates in accordance with the display state of the liquid crystal cell $LC_{ij}$, and as a result, there is a limit to the effective removal of the DC component by only applying a bias voltage to the common electrode.

As described in the above, in the Japanese Unexamined Patent Publication Nos. 63-96636, 2-214819, 4-14091, 4-14092 and 4-102825, active matrix-type display devices generating no DC component are disclosed.

Figure 5:
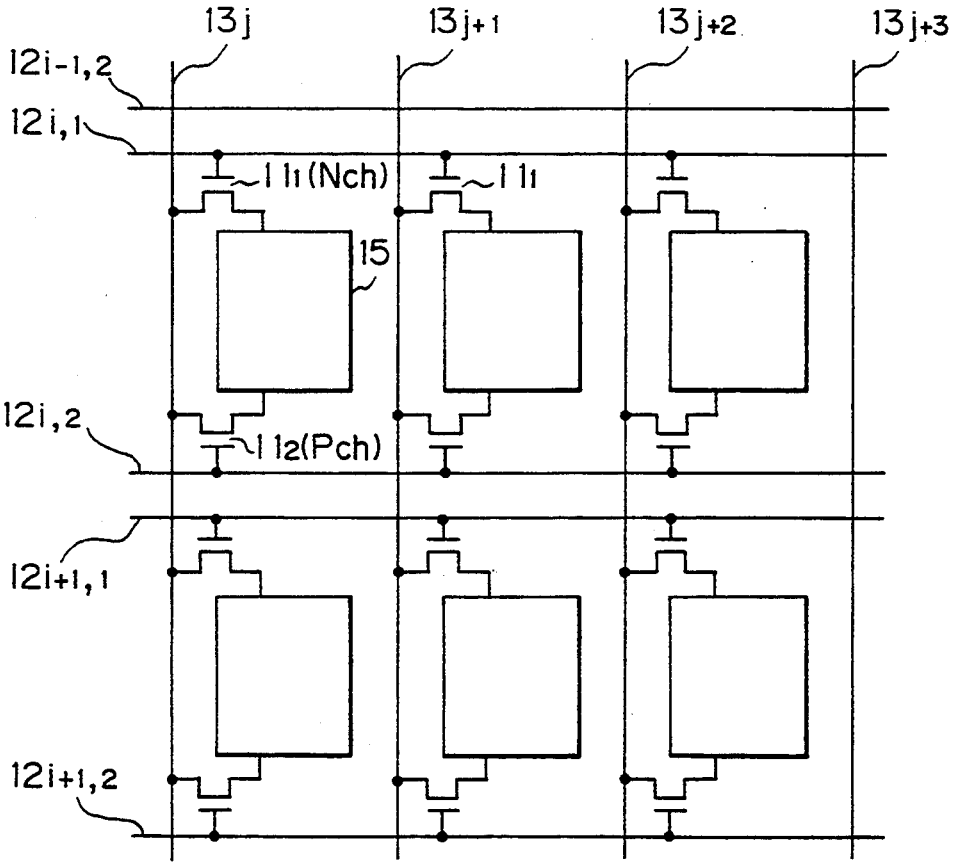
Fig. 5 PRIOR ART
FIG. 5 is a circuit diagram illustrating a prior art active matrix-type display device in which DC components are compensated.

FIG. 5 is a circuit diagram illustrating an active matrix-type display device in which no DC component is generated, however, which is different in the detail from those shown in the above documents. As shown in the figure, two scan bus lines $12_{i,j}$ and $12_{i,2}$ are provided at the upper side and lower side of each row of pixels, and each pixel electrode is connected to the same data bus line via two kinds of TFT $11_1$ and $11_2$. Nch-type TFTs $11_1$ are connected to the upper side scan bus line $12_{i,1}$, and P-channel-type TFTs $11_2$ are connected to the lower side scan bus line $12_{i,2}$. By applying address pulses having symmetric positive and negative wave forms respectively to the scan bus lines $12_{i,1}$ and $12_{i,2}$, two TFT $11_1$ and $11_2$ are simultaneously turned ON. Since these address pulses have symmetric positive and negative wave forms, the DC component resulting from the parasitic static capacities are canceled if parasitic static capacities exist between the pixel electrode and two scan bus lines.

As explained in the above with reference to FIG. 1, the scan bus driver 211 only outputs the address pulses for turning ON the TFTs. Therefore, the scan bus driver can be realized by a simple construction. Compared to this, the data bus driver 214 outputs the data voltages applied to the pixel cells, and these data voltages are required to have precise amplitudes because the pixel material changes its state according to the applied data voltage. Consequently, the data bus driver is required to output precise voltages compared to the scan bus driver. Further, the shift register of the data bus driver is required to operate at a higher clock rate than that of the scan bus driver because the shift register of the data bus driver operates in synchronization with a clock signal but the shift register of the scan bus driver operates in synchronization with the HSYNC signal.

Further, if the gradation of display is performed, the shift register/latch 215 is required to shift and latches multi-bits data corresponding to the gradation levels, and the number of switches of the data voltage selecting switch array 216 also increases. Therefore, the construction of the data bus driver 212 is further complex compared to the scan bus driver 211.

A normal active matrix-type display device has more pixels in the row direction (horizontal direction), for example, 640 dots×480 dots. Therefore, the number of data bus drivers is larger than that of scan bus drivers. Further, when a color display is performed, one pixel is preferably composed of three RGB components arranged in the row direction. Consequently, the number of data bus lines is quadruple that of the scan bus lines.

The scan bus lines and the data bus lines are perpendicularly crossed. If the number of data bus lines is much larger than that of scan bus lines, the freedom of the layout of the display panel is limited. As described in the above, since the data bus driver is complex compared to the scan bus driver, the number of data bus lines is required to decrease although the number of scan bus lines increases.

As described in the above, the Japanese Unexamined Patent Publication Nos. 62-218987 and 3-38689 disclose an active matrix-type display device in which the number of data bus lines are reduced. In the display devices disclosed in these documents, two pixel electrodes are respectively connected to the same data bus line via two independently controllable switching elements, and these two switching elements are driven in time division sequences. In these devices, it is important that two switching elements connected to the same data bus line are independently controllable. To cope with this, two scan bus lines are provided, or two kinds of switching elements are used. In this device, the above-mentioned DC component is also generated, and the display quality and the life-time are reduced. Therefore, a device in which the number of data bus lines is reduced and high display quality is obtained is desired.

Figure 6:
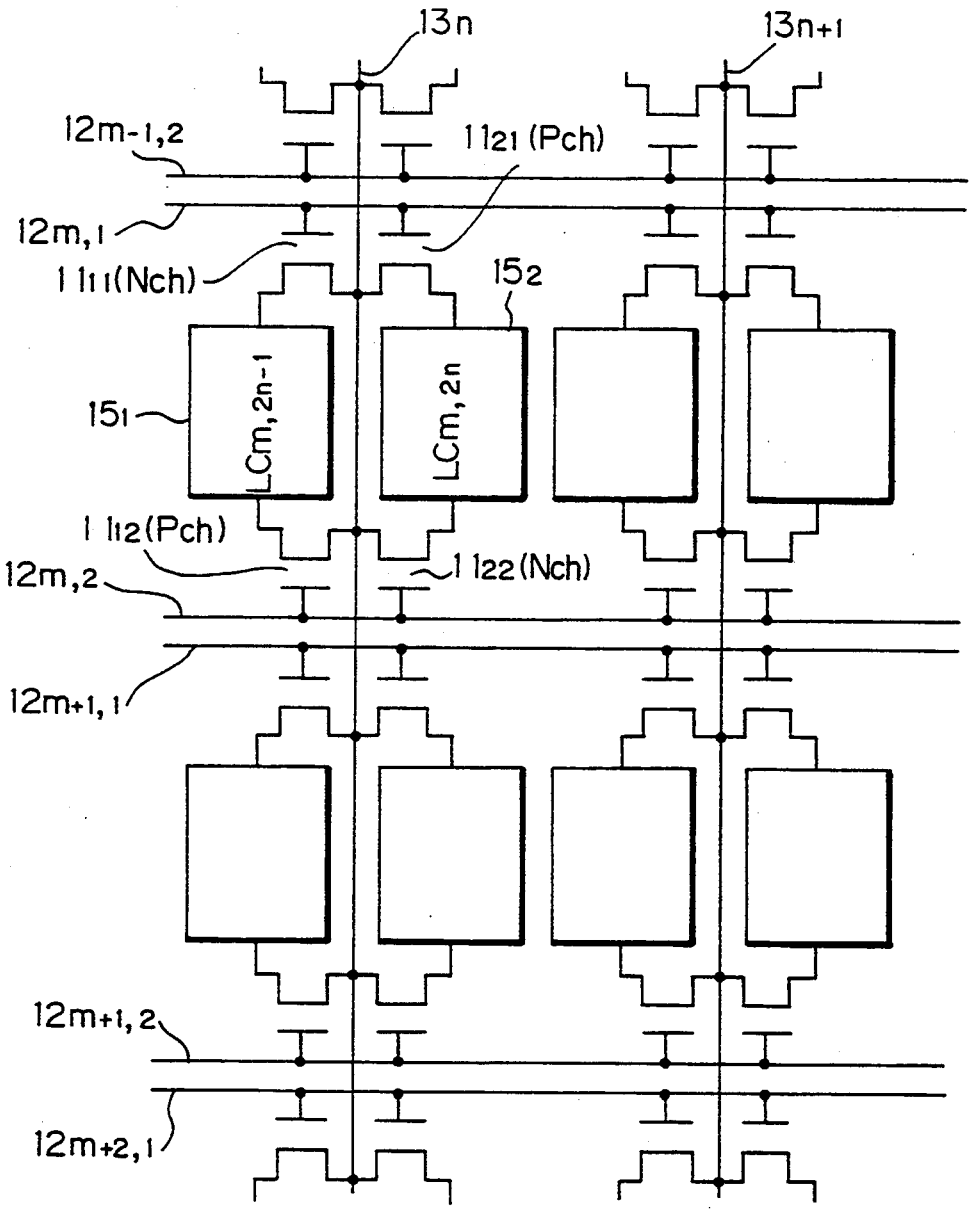
FIG. 6 is a circuit diagram illustrating an embodiment of the active matrix-type liquid crystal display device according to the present invention.

FIG. 6 is a circuit diagram illustrating a first embodiment of the active matrix-type display device according to the present invention. This embodiment is a normal type (not counter-matrix type) active matrix-type liquid crystal display device to which the present invention is applied.

As shown in FIG. 6, the active matrix-type liquid crystal display device of this embodiment provides a plurality of pairs of scan bus lines $\mathbf{12}_{m,1}$, $\mathbf{12}_{m,2}$, $\mathbf{12}_{m+1,1}$, $\mathbf{12}_{m+1,2}$, . . . , a plurality of data bus lines $\mathbf{13}_n$, $\mathbf{13}_{n+1}$, . . . perpendicularly arranged to the scan bus lines, pixel electrodes $\mathbf{15}_1$, $\mathbf{15}_2$, . . . arranged within pixel areas in a matrix partitioned by the scan bus lines and the data bus lines , and thin film transistors (TFTs) $\mathbf{11}_{11}$, $\mathbf{11}_{12}$, $\mathbf{11}_{21}$, $\mathbf{11}_{22}$ . . . connected between the data bus lines $\mathbf{13}_n$, $\mathbf{13}_{n+1}$, . . . and the pixel electrodes $\mathbf{15}_1$, $\mathbf{15}_2$, . . . . In this embodiment, the above elements are formed on a glass substrate, and a wide spread common electrode is formed on the other glass substrate as counter pixel electrodes. This common electrode is connected to the ground. These two glass substrates are arranged in parallel formation, and liquid crystal material is filled between thereof. Liquid crystal cells $LC_{m,2n-1}$, $LC_{m,2n}$ are formed by the pixel electrodes with the liquid crystal material.

The TFTs are composed of two kinds such as N-channel type TFTs and P-channel type TFTs. The N-channel type TFT is turned ON when a positive voltage is applied to its control gate, and the P-channel type TFT is turned ON when a negative voltage is applied to its control gate.

As shown in FIG. 6, two scan bus lines such as $\mathbf{12}_{m,1}$ and $\mathbf{12}_{m,2}$ are provided for one pixel row (a row of pixels arranged in a horizontal direction in FIG. 6), and one line of the pair is arranged at an upper side of the pixel row and the other line is arranged at a lower side of the pixel row. An N-channel type TFT and a P-channel type TFT are connected to each pixel electrode, and both TFTs are connected to the same data bus line. Further, two pixel electrodes are connected to the same data bus line. That is, four TFTs connected to one pixel pair are connected to the same data bus line. And gates of an N-channel type TFT connected to the first pixel electrode of the pair and a P-channel type TFT connected to the second pixel electrode of the pair are connected to the upper side scan bus line of the pair, and gates of a P-channel type TFT connected to the first electrode of the pixel pair and an N-channel type TFT connected to the second electrode of the pixel pair are connected to the lower side scan bus line of the pair. For example, as shown in FIG. 6, gates of an N-channel type TFT $\mathbf{11}_{11}$ and P-channel type TFT $\mathbf{11}_{21}$ are connected to the scan bus line $\mathbf{12}_{m,1}$, and gates of a P-channel type TFT $\mathbf{11}_{12}$ and an N-channel type TFT $\mathbf{11}_{22}$ are connected to the scan bus line $\mathbf{12}_{m,2}$.

By connecting TFTs in this way, two liquid crystal cells of the pixel pair can be independently controlled when two address pulses being compensable to each other are applied to two scan bus lines corresponding to the pixel row. This is important for the present invention. In the device of FIG. 5, two scan bus lines are already provided for one pixel row and two different TFTs are also provided for one cell. If two pixel electrodes are connected to each data bus line in the device of FIG. 5, two additional scan bus lines are required for each pixel row in order to access both cells independently. However, in this embodiment, the number of scan bus lines is equal to that of FIG. 5 and any other elements are not increased, although only connections of the TFTs are changed. Further, as explained in the following, the generation of the DC component can also be prevented.

FIGS. 7A through 7G show the signals of the scan bus lines $\mathbf{12}_{m,1}$, $\mathbf{12}_{m,2}$, $\mathbf{12}_{m+1,1}$, $\mathbf{12}_{m+1,2}$, and data bus lines $\mathbf{13}_n$, $\mathbf{13}_{n+1}$, and the voltages of the liquid crystal cells $LC_{m,2n-1}$, $LC_{m,2n}$ of FIG. 6. $SC_{m,1}$ designates an address signal applied to the scan bus line $\mathbf{12}_{m,1}$, and $SD_n$ designates a signal applied to the data bus line $\mathbf{13}_n$, and $VLC_{m,2n-1}$ designates a voltage signal of the cell $LC_{m,2n-1}$.

Figures 7A, 7B, 7C, 7D, 7E, 7F, 7G:
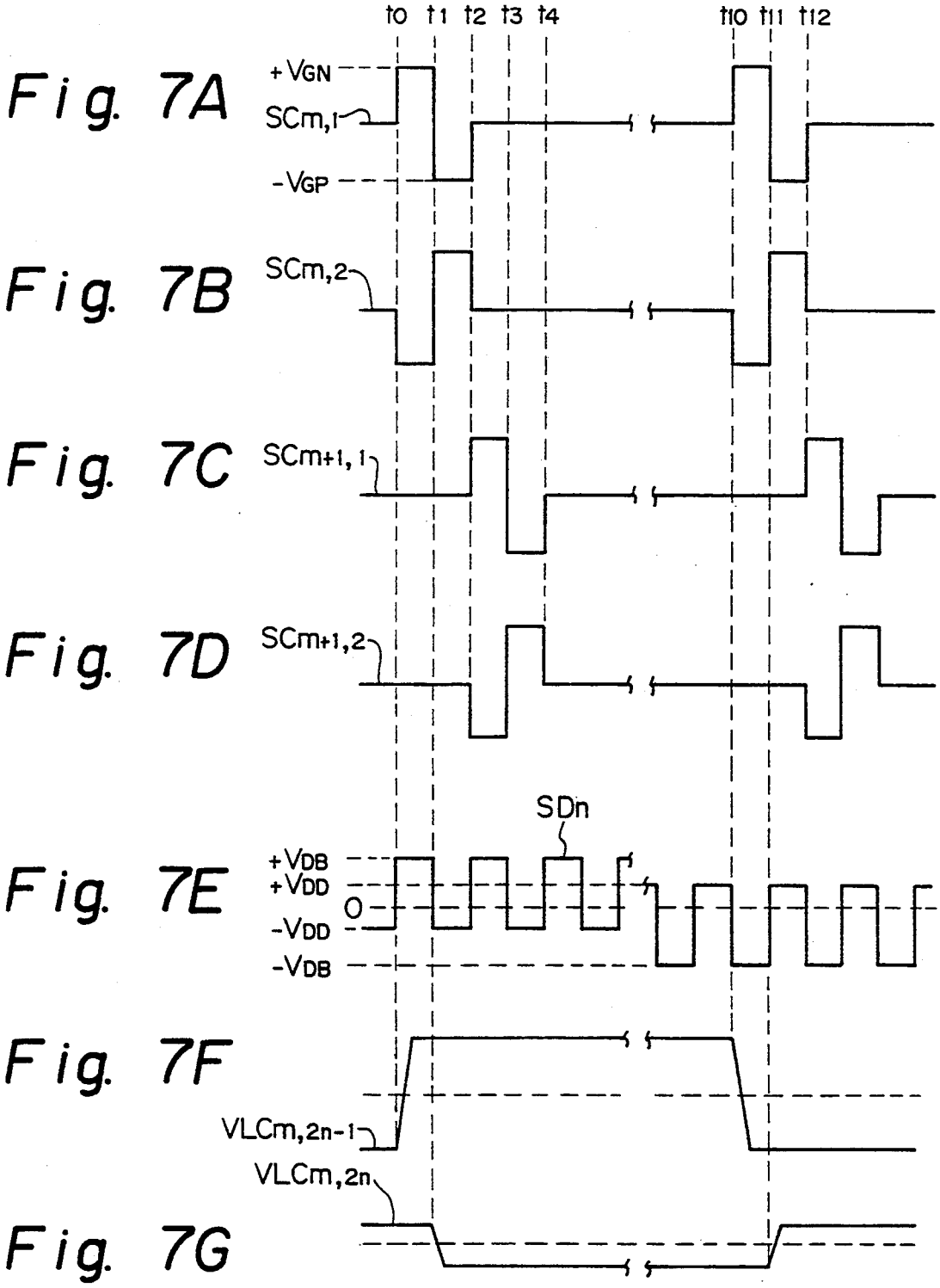
FIGS. 7A through 7G are timing diagrams showing the signals in the circuit of FIG. 6.
Figures 8A, 8B, 8C, 8D:
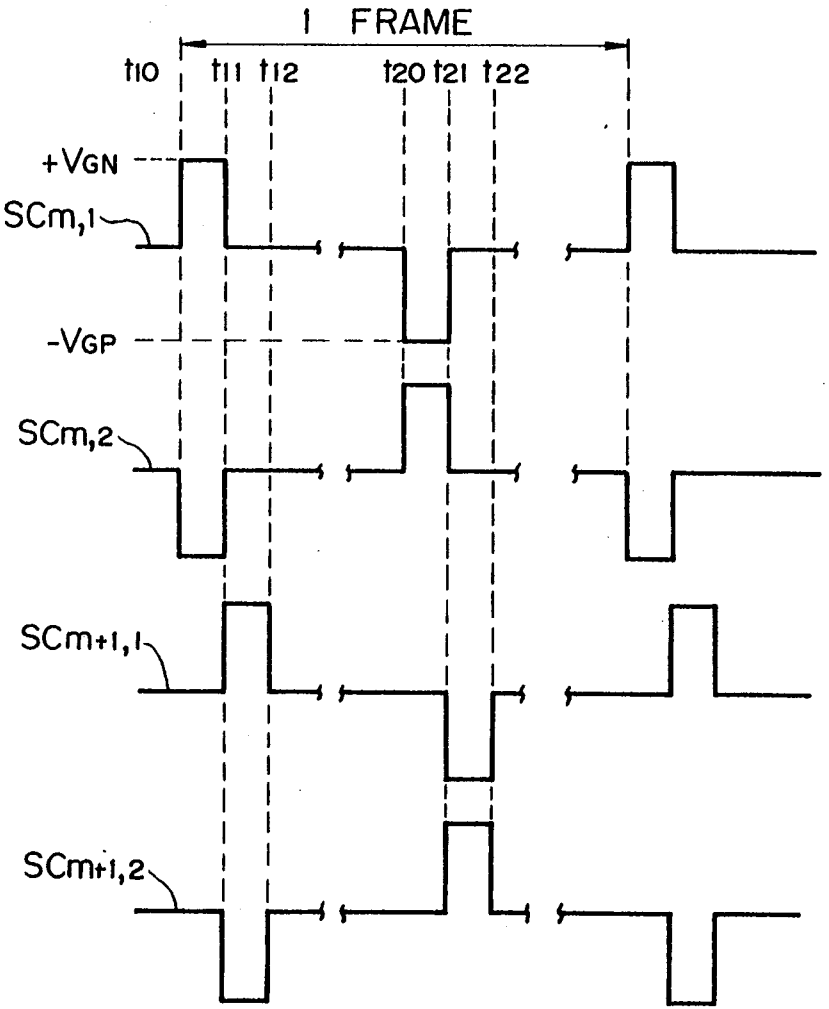
FIGS. 8A through 8D are timing diagrams showing the signals in the circuit of FIG. 6.
Figures 9A, 9B, 9C, 9D, 9E, 9F:
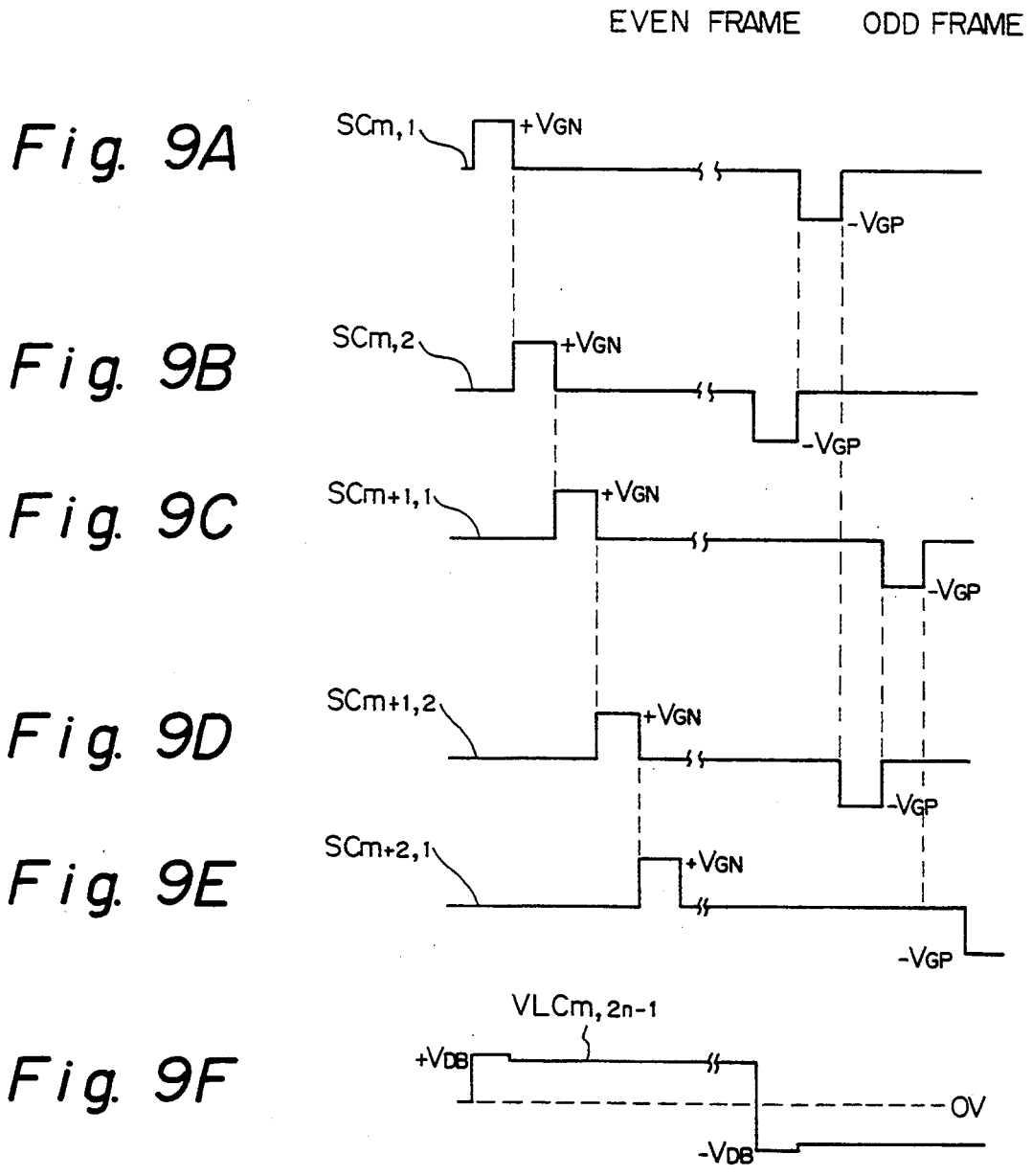
FIGS. 9A through 9F are timing diagrams showing the signals in the circuit of FIG. 6.

As shown in FIGS. 7A through 7D, two address signals applied to the pair of the scan bus lines such as $\mathbf{12}_{m,1}$ and $\mathbf{12}_{m,2}$ have opposite polarities to each other, and each of the address pulses is composed of two consecutive positive and negative pulses each having a pulse width being almost a half of one horizontal scanning period ($\frac{1}{2}$ $t_H$), and their amplitudes are $+V_{GN}$ and $-V_{GP}$, respectively. Incidentally, in figures of the signals, the amplitudes of the address pulses are not much larger because of insufficient space, however, in practice, the amplitudes of the address pulses are enough for the TFTs to operate within saturation areas. The cell $LC_{m,2n-1}$ is accessed during time $t_0$ to time $t_1$ of FIGS. 7A to 7G. When the cell $LC_{m,2n-1}$ is accessed, two address signals as shown in FIGS. 7A and 7B are applied to the scan bus line $\mathbf{12}_{m,1}$ and the scan bus line $\mathbf{12}_{m,2}$. By this, a positive pulse is applied to the control gates of the N-channel type TFT $\mathbf{11}_{11}$ and the P-channel type TFT $\mathbf{11}_{21}$, and a negative pulse is applied to the gates of the P-channel type TFT $\mathbf{11}_{22}$ and the N-channel type TFT $\mathbf{11}_{22}$. Therefore, the N-channel type TFT $\mathbf{11}_{11}$ and the P-channel type TFT $\mathbf{11}_{12}$ are turned ON, and the pixel electrode $\mathbf{15}_1$ is connected to the data bus line $\mathbf{13}_n$. However, the P-channel type TFT $\mathbf{11}_{21}$ and the N-channel type TFT $\mathbf{11}_{22}$ are not turned ON. Since the pixel electrode $\mathbf{15}_1$ is connected to the data bus line $\mathbf{13}_n$, the pixel electrode $\mathbf{15}_1$ is charged to the potential of the data bus line $\mathbf{13}_n$. As shown in FIG. 7F, the potential of the data bus line $\mathbf{13}_n$ is $+V_{DB}$ at this time, therefore, the liquid crystal cell $LC_{m,2n-1}$ is charged to $+V_{DB}$.

At time $t_1$, the potential of the scan bus line $\mathbf{12}_{m,1}$ changes to negative and the potential of the scan bus line $\mathbf{12}_{m,2}$ changes to positive. And then, the N-channel type $TFT_{11}$ and the P-channel type $TFT_{12}$ are turned OFF, and the P-channel type TFT $\mathbf{11}_{21}$ and the N-channel type $TFT_{22}$ are turned ON. As a result, the pixel electrode $\mathbf{15}_1$ is cut off from the data bus line $\mathbf{13}_n$, and the charged voltage $+V_{DB}$ is maintained thereafter. At the same time, the pixel electrode $\mathbf{15}_2$ is connected to the data bus line $\mathbf{13}_n$, and the liquid crystal cell $LC_{m,2n}$ is charged to the potential $-V_{DD}$. The charging of the liquid crystal cell $LC_{m,2n}$ finishes at time $t_2$. That is, access to the pixel row including the liquid crystal cells $LC_{m,2n-1}$. $LC_{m,2n}$ finishes from time $t_0$ through time $t_2$. Consequently, this period from time to through time $t_0$ corresponds to the conventional horizontal scanning time $t_H$.

In the next period from time $t_2$ to $t_4$, similar address signals are applied to the next pair of scan bus lines $\mathbf{12}_{m+1,1}$, $\mathbf{12}_{m+1,2}$. That is, the address signal applied to the next pair is shifted for one horizontal scanning period $t_H$. And then, pairs of the liquid crystal cells of the next row are charged in the same way. In this way, liquid crystal cells of all pixel rows are sequentially charged, and at time $t_{10}$, the pixel row including the liquid crystal cells $LC_{m,2n-1}$ and $LC_{m,2n}$ are accessed again. From time $t_{10}$ through time $t_{11}$, the same address signals as described in the above are applied to the scan bus lines $\mathbf{12}_{m,1}$, $\mathbf{12}_{m,2}$, and the liquid crystal cells $LC_{m,2n-1}$, $LC_{m,2n}$ are charged to voltages corresponding to the potential of the data bus line $\mathbf{13}_n$. As shown in FIG. 7E, the voltage of the data bus line $\mathbf{13}_n$ is $-V_{DB}$ when the liquid crystal cell $LC_{m,2n-1}$ is accessed, and the voltage of the data bus line $\mathbf{13}_n$ is $+V_{DD}$. Therefore, liquid crystal cells are respectively charged at $-V_{DB}$ and $+V_{DD}$. In this way, each liquid crystal cell is periodically charged with positive and negative potential for each frame. In the liquid crystal display device designed as normally black mode, large fluctuation voltage corresponds to a bright display. Therefore, since the absolute value of the voltage $V_{DD}$ is larger than the absolute value of the voltage $V_{DB}$, the liquid crystal cell $LC_{m,2n-1}$ is brighter than the cell $LC_{m,2n}$. By this data signal, a lattice pattern of bright and dark is displayed. In the display designed as normally white mode, the relation of the brightness is reversed.

As described in the above, when the liquid crystal cell is accessed, the address pulses having opposite polarities are applied to the scan bus lines arranged at both sides of the pixel row, which includes the liquid crystal cell. Each address pulse generates the DC component, however, shift directions of the DC components due to the above two positive and negative address pulses are opposite. Consequently, two DC components operate to cancel each other.

When these two DC components have the same amplitudes, two DC components can be perfectly canceled. As illustrated by the formula (1), an amplitude of a DC component is decided by the parasitic static capacity between the pixel electrode and the scan bus line and the amplitude of the address pulse.

Each of the address signals has a positive pulse of the voltage $+V_{GN}$ and a negative pulse of the voltage $-V_{GP}$. These voltages $+V_{GN}$ and $-V_{GP}$ are determined so as to satisfy the following relationship:

$$C_{gPN} \times V_{GN} = C_{gPP} \times V_{GP} \quad (2)$$

where, $C_{gPN}$ is a parasitic electrostatic capacity between the scan bus line such as $\mathbf{12}_{m,1}$ and the pixel electrode such as $\mathbf{15}_{11}$;

$C_{gPP}$ is a parasitic electrostatic capacity between the scan bus line such as $\mathbf{12}_{m,2}$ and the pixel electrode such as $\mathbf{15}_{11}$;

If the above formula is satisfied, the level shift voltage by the N-channel type TFT is canceled by the level shift voltage by the P-channel type TFT. As a result, the total shift voltage becomes zero.

Therefore, if the parasitic static capacities between the pixel electrode and two scan bus lines arranged at both sides of the pixel row are equal, by applying two address pulses having the same amplitudes and polarities opposite both scan bus lines, DC components can be perfectly canceled. That is, if $V_{GN}$ is equal to $V_{GP}$ in FIGS. 7A through 7D, DC components are canceled.

And, if the above-mentioned two parasitic static capacities are different, the amplitudes of the decided pulses according to the formula (2) may be used. Consequently, by adjusting the ratio of two parasitic static capacities $C_{gPN}$ and $C_{gPP}$, the potential levels can be freely decided, and the zero level of the address pulses are also changed.

As described in the above, in this embodiment, the number of data bus lines is reduced to half of that of the prior art device and the generation of flickers and residual images and a reduction in the life of the device can be prevented.

Further, in this embodiment, since each liquid crystal cell is controlled by two switching elements, the cell can be controllable when one of switching elements is defective.

In FIGS. 7A through 7D, each of the address signals applied to scan bus lines has two consecutive address pulses of opposite polarity. These two address pulses respectively operate as address pulses for accessing different liquid crystal cells. Therefore, these two address pulses are not required to be consecutive. It is only required that two compensable address pulses are simultaneously applied to two scan bus lines of both sides of a pixel row. FIGS. 8A through 8D show another address signal of the device of FIG. 6. In FIGS. 8A through 8D, the liquid crystal cell $LC_{m,2n-1}$ is accessed from $t_{10}$ to $t_{11}$, the liquid crystal cell $LC_{m,2n}$ is accessed from $t_{20}$ to $t_{21}$.

In FIG. 7E, the data voltage signal $SD_n$ applied to the data bus line $\mathbf{13}_n$ changes from positive voltage to negative voltage within one horizontal scanning period $t_H$. By this, two liquid crystal cells of the pair are respectively charged to positive and negative. However, the data signal may change for each frame. When the data signal $SD_n$ changes within positive voltages in one frame and changes within negative voltages in the next frame, all liquid crystal cells are charged to the same polarities in one frame.

FIGS. 9A through 9F show another modified example of the address signal and the voltage fluctuation of the liquid crystal cell. As shown in the figures, positive address pulses shifted for a half of one horizontal scanning period ($\frac{1}{2}$ $t_H$) are sequentially applied to the following scan bus lines in the even frame. By these address pulses, liquid crystal cells are accessed in a sequence such as $\mathbf{12}_{m,1}$, $\mathbf{12}_{m,2}$, $\mathbf{12}_{m+1,1}$, $\mathbf{12}_{m+1,2}$, $\mathbf{12}_{m+2,1}$ . . . . In the odd frame, negative address pulses are applied. These negative address pulses are also shifted for each pixel row, however, those orders within each pixel row are replaced. For example, a positive address pulse designated by oblique lines of the address signal $SC_{m,1}$ is before a positive address pulse of the address signal $SC_{m,2}$ in the even frame, however, a negative address pulse designated by oblique lines of the address signal $SC_{m,1}$ is after a negative address pulse of the address signal $SC_{m,2}$ in the odd frame. Address pulses for the liquid crystal cell $LC_{m,2n-1}$ are the positive address pulse of the address signal $SC_{m,1}$ and the negative address pulse of the address signal $SC_{m,2}$ which are address pulses designated by oblique lines. Address pulses for the liquid crystal cell $LC_{m,2n}$ are the positive address pulse of the address signal $SC_{m,2}$ and the negative address pulse of the address signal $SC_{m,1}$. Therefore, liquid crystal cells are accessed in the same sequence in both even and odd frames.

When the device is driven by the address signal shown in FIGS. 9A through 9E, DC components resulting from the address pulses cannot be canceled at that time since positive and negative address pulses are not simultaneously applied. This DC component is shown as a small fluctuation of the cell voltage $VLC_{m,2n-1}$ of FIG. 9F. However, these DC components have opposite directions for each frame. Therefore, by balancing the DC components generated in both even and odd frames, two DC components can be canceled.

In the first embodiment, two thin film transistors (TFTs) having different polarities are connected to one pixel electrode. By this construction, since each liquid crystal cell is driven by two switching elements, the reliability of the device can be increased, and further, two parasitic static capacities between the pixel electrode and two scan bus lines arranged at both sides can be easily balanced. Therefore, two symmetric address pulses having opposite polarity can be applied for canceling the DC components.

However, the DC component due to parasitic capacitances between the pixel electrode and the scan bus lines is canceled only by a compensable address pulse applied to the other scan bus line of the opposite side, and the TFT itself as a switching element does not directly operate for the compensation. Therefore, although one pair of TFTs is eliminated from the circuit of FIG. 6, the compensation of the DC component can be performed. The second embodiment is an example of this kind.

Figure 10:
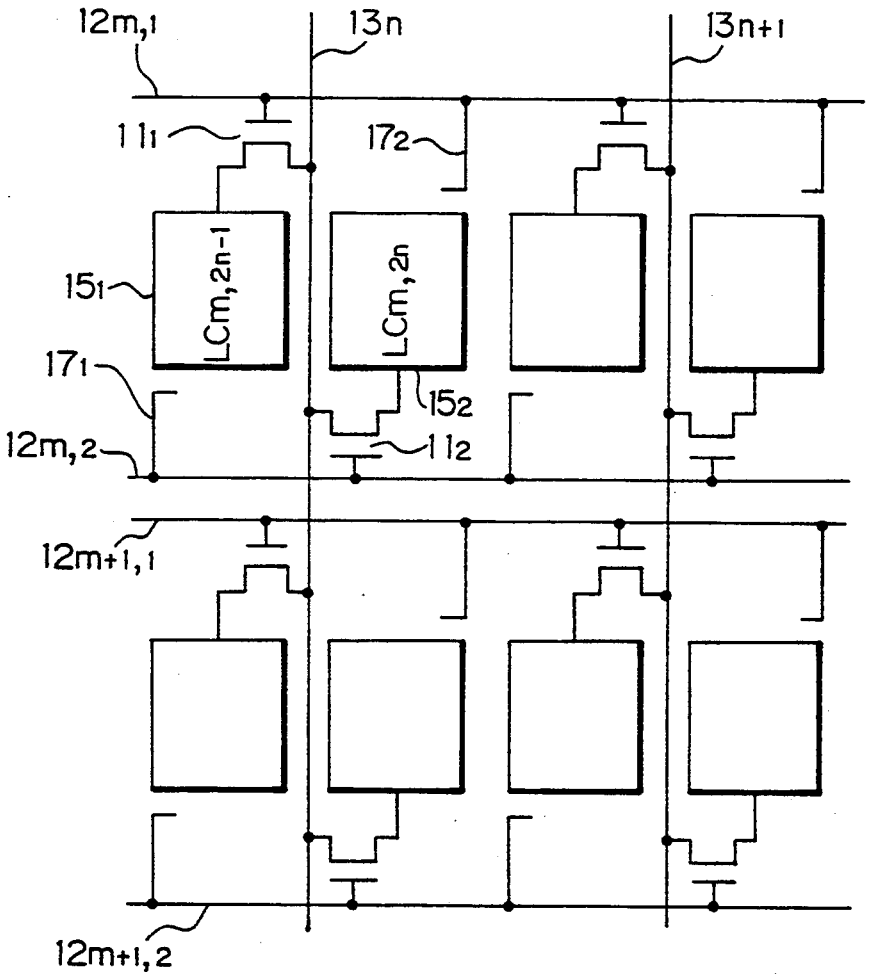
FIG. 10 is a circuit diagram illustrating a second embodiment of the active matrix-type liquid crystal display device according to the present invention.

FIG. 10 shows a circuit diagram of the second embodiment.

As shown in FIG. 10, the device of the second embodiment provides a plurality of pairs of two scan bus lines $\mathbf{12}_{m,1}$, $\mathbf{12}_{m,2}$, $\mathbf{12}_{m+1,1}$, $\mathbf{12}_{m+1,2}$, . . . , a plurality of data bus lines $\mathbf{13}_n$, $\mathbf{13}_{n+1}$, . . . perpendicularly arranged to the scan bus lines, a plurality of pixel electrodes arranged in a matrix, and a plurality of thin film transistors (TFTs). One TFT is provided for one pixel electrode, and these TFTs operate by signals having the same polarity. In this embodiment, all TFTs are the N-channel type. Further, auxiliary lines $\mathbf{17}_1$, $\mathbf{17}_2$ . . . are provided. These elements are formed on one glass substrate, and a common electrode operating as a counter pixel electrode is formed on the other glass substrate. These two glass substrates are arranged in parallel formation, and liquid crystal material is filled between them. Liquid crystal cells $LC_{m,2n-1}$, $LC_{m,2n}$ . . . are formed between the pixel electrodes.

Two scan bus lines $\mathbf{12}_{m,1}$, $\mathbf{12}_{m,2}$ are provided for one pixel row, and one scan bus line $\mathbf{12}_{m,1}$ is at the upper side of the pixel row, and the other scan bus line $\mathbf{12}_{m,2}$ is at the lower side of the pixel row. Two liquid crystal cells $LC_{m,2n-1}$, $LC_{m,2n}$ make a pair, and two pixel electrodes $\mathbf{15}_1$, $\mathbf{15}_2$ of the pair of the liquid crystal cells are connected to the same data bus line $\mathbf{13}_n$ via TFT $\mathbf{11}_1$ and TFT $\mathbf{11}_2$. A control gate of the TFT $\mathbf{11}_1$ is connected to the scan bus line $\mathbf{12}_{m,1}$, and a control gate of the TFT $\mathbf{11}_2$ is connected to the scan bus line $\mathbf{12}_{m,2}$.

The auxiliary lines $\mathbf{17}_1$, $\mathbf{17}_2$ . . . are lines elongated from the scan bus lines to the pixel electrodes. The auxiliary line $\mathbf{17}_1$ elongates from the lower side scan bus line $\mathbf{12}_{m,2}$ to the pixel electrode $\mathbf{15}_1$, and the auxiliary line $\mathbf{17}_2$ elongates from the upper side scan bus line $\mathbf{12}_{m,1}$ to the pixel electrode $\mathbf{15}_2$. By the auxiliary lines, static capacitances exist between the pixel electrodes and the scan bus lines. For increasing the static capacitances between the pixel electrodes and the scan bus lines, other methods, for example, to form overlapped portions between the pixel electrodes and the scan bus lines, are available.

Compared with FIG. 6, excepting the auxiliary lines, the circuit of FIG. 10 is equal to that of FIG. 6 from which P-channel type TFTs are eliminated. Further, this circuit is similar to that disclosed in a figure of the above-mentioned Japanese Unexamined Patent Publication 3-38689, which is an invention for reducing the number of data bus lines.

In the circuit of FIG. 10, when the voltages of the address pulses are decided according to the ratio of the parasitic static capacitances between each pixel electrode and two scan bus lines of both sides, DC components can be canceled by applying address signals of FIGS. 7A through 7D. In a duration from $t_0$ to $t_1$, a positive pulse of the address signal $SC_{m,1}$ is applied to the scan bus line $\mathbf{12}_{m,1}$, and the TFT $\mathbf{11}_1$ is conducted. At this time, since a negative pulse of the address signal $SC_{m,2}$ is applied to the scan bus line $\mathbf{12}_{m,2}$, a DC component generated by the positive pulse is canceled by the negative pulse. The TFT $\mathbf{11}_2$ is not conducted by this negative pulse since the TFT $\mathbf{11}_2$ is an N-channel TFT. Therefore, only the liquid crystal cell $LC_{m,2n-1}$ is accessed in this duration.

In a next duration from $t_0$ to $t_1$, a positive pulse of the address signal $SC_{m,2}$ is applied to the scan bus line $\mathbf{12}_{m,2}$, and the TFT $\mathbf{11}_2$ is conducted. At this time, the negative pulse on the scan bus line $12_{m,1}$ cancels the the DC component generated by the positive pulse on the scan bus line $12_2$. The TFT $11_1$ is not conducted during this duration, and only the liquid crystal cell $LC_{m,2n}$ is accessed.

Liquid crystal cells of the following pixel rows are similarly accessed.

In the second embodiment, liquid crystal cells are accessed only by positive pulses, and negative pulses are only for compensation. And, similarly to the first embodiment, two positive and negative pulses are not required to be consecutive.

Address signal of FIGS. 9A through 9E can be applied in the first embodiment, but cannot be applied in the second embodiment.

In FIG. 10, auxiliary lines $17_1$, $17_2$ . . . are provided for adjusting the parasitic static capacitence between the pixel electrode and the scan bus line to which the pixel is not connected. That is, the auxiliary line $17_1$ increases the parasitic static capacitence between the pixel electrode $15_1$ and the lower side scan bus line $12_{m,2}$, and the auxiliary line $17_1$ increases the parasitic static capacity between the pixel electrode $15_2$ and the upper side scan bus line $12_{m,1}$. Therefore, the voltage of the negative pulse for compensation can be reduced. As described in the above, since the negative pulses operate only as compensation pulses, it is good that these amplitudes are small. Further, the base level of the address pulses can be shifted to the negative. By this, the N-channel TFTs operate more stably.

Figure 11:
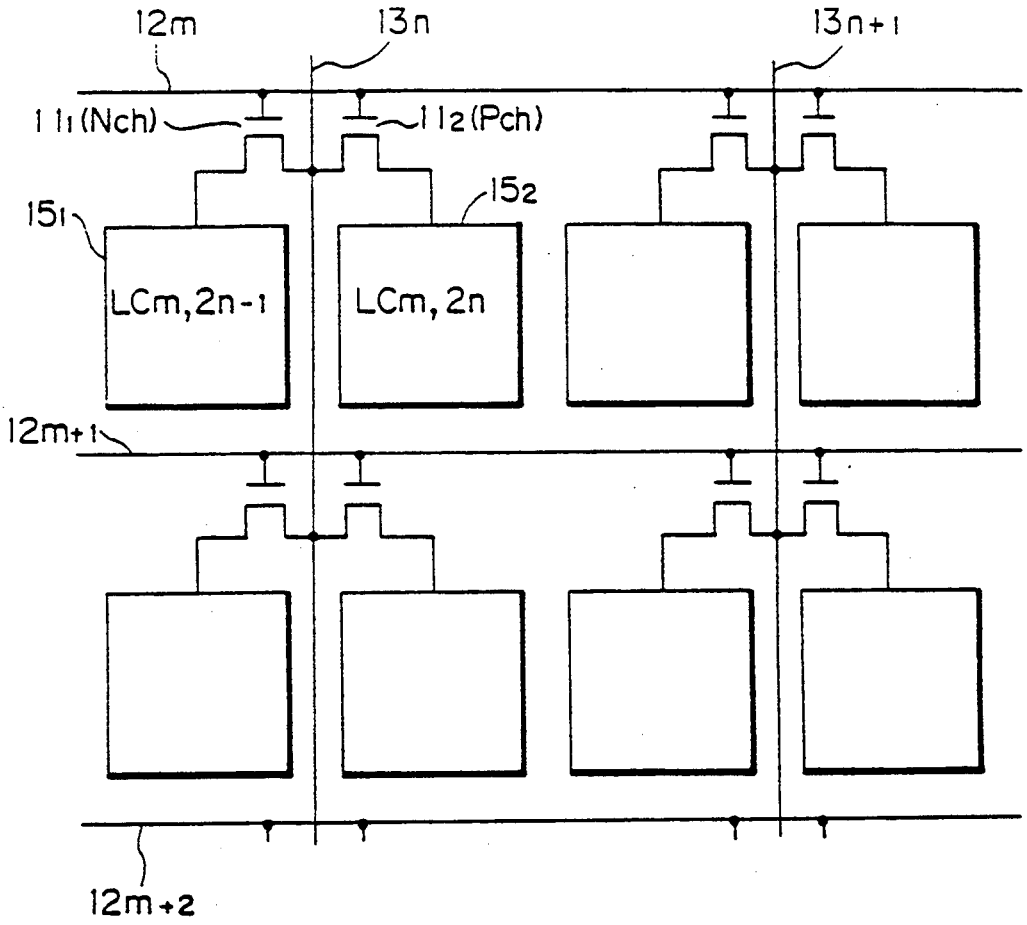
FIG. 11 is a circuit diagram illustrating a third embodiment of the active matrix-type liquid crystal display device according to the present invention.

FIG. 11 shows a circuit diagram of the third embodiment.

As shown in FIG. 11, the device of the third embodiment provides a plurality of scan bus lines $12_m$, $12_{m+1}$, . . . , a plurality of data bus lines $13_n$, $13_{n+1}$, . . . perpendicularly arranged to the scan bus lines, a plurality of pixel electrodes arranged in a matrix, and a plurality of thin film transistors (TFTs). In this embodiment, the TFTs are composed of N-channel type TFTs and P-channel type TFTs. For example, the TFT $11_1$ is an N-channel type TFT, and the TFT $11_2$ is a P-channel type TFT. These elements are formed on one glass substrate, and a common electrode operating as counter pixel electrodes is formed on the other glass substrate. These two glass substrates are arranged in parallel formation, and liquid crystal material is parallel between them. Liquid crystal cells $LC_{m,2n-1}$, $LC_{m,2n}$ . . . are formed between the pixel electrodes.

One scan bus line $12_m$ are provided for each pixel row, and this scan bus line $12_m$ is arranged at the upstream side of the scanning direction. Two liquid crystal cells $LC_{m,2n-1}$, $LC_{m,2n}$ make a pair, and two pixel electrodes $15_1$, $15_2$ of the pair of the liquid crystal cells are connected to the same data bus line $13_n$ via TFT $11_1$ and TFT $11_2$. Both control gates of the TFTs $11_1$, $11_2$ are connected to the scan bus line $12_m$.

Compared with FIG. 6, the circuit of FIG. 11 is equal to that of FIG. 6 from which scan bus lines of the lower side and pairs of TFTs connected to the scan bus lines of the lower side are eliminated. Further, this circuit is the circuit disclosed in a figure of the above-mentioned Japanese Unexamined Patent Publication 62-218987, which is an invention for reducing the number of data bus lines.

FIGS. 12A through 12E show a data signal $SD_n$ applied to the data bus lines $13_n$, address signals $SC_m$, $SC_{m+1}$ applied to the scan bus lines $12_m$, $12_{m+1}$, and the voltages $VLC_{m,2n-1}$, $VLC_{m,2n}$ of the liquid crystal cells $LC_{m,2-n}$, $LC_{m,2n}$ of FIG. 11.

Figures 12A, 12B, 12C, 12D, 12E:
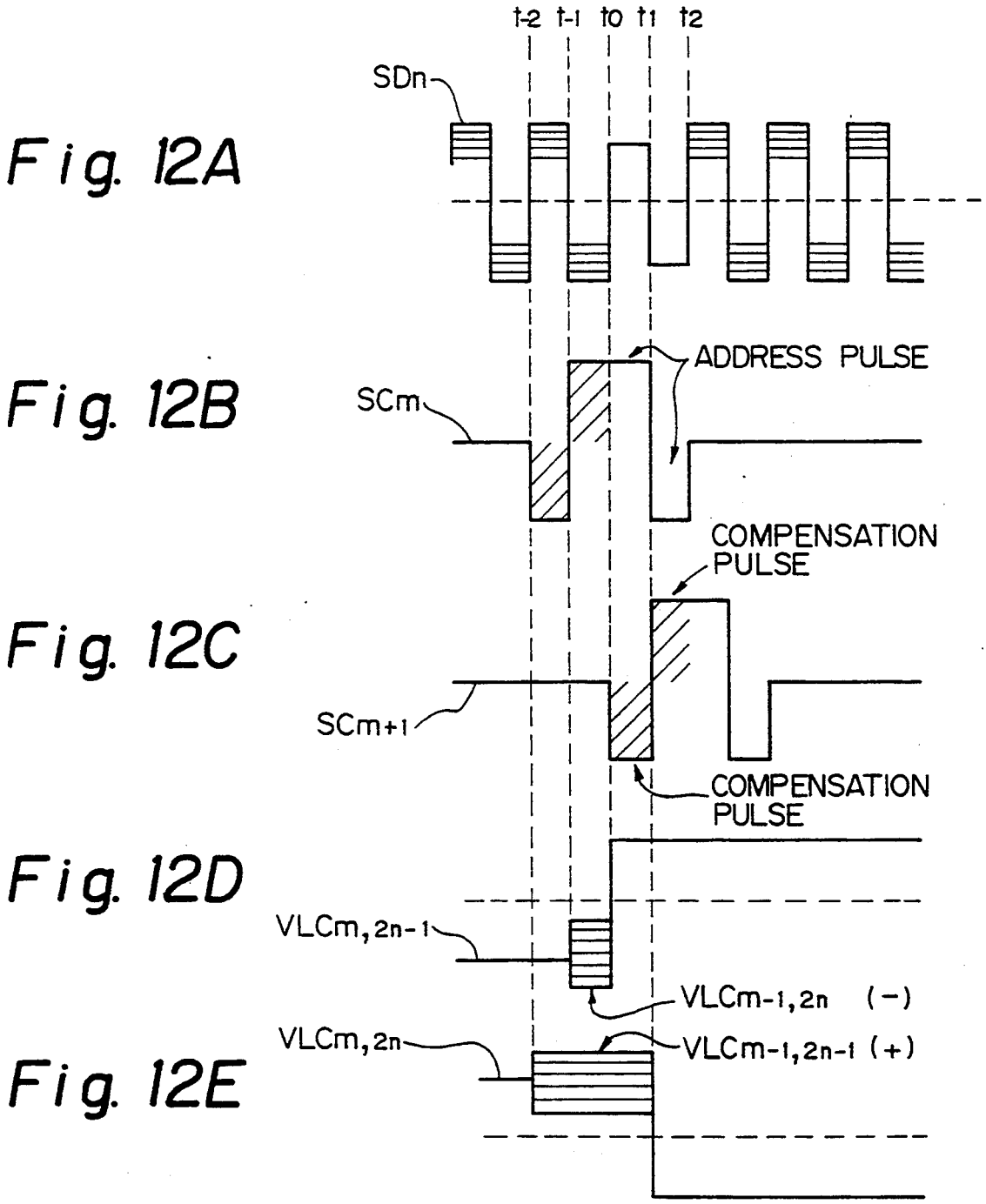
FIGS. 12A through 12E are timing diagrams showing the signals in the circuit of FIG. 11.

As shown in FIGS. 12B and 12C, each of the address signals applied to each scan bus line such as $12_m$, $12_{m+1}$ are composed of two portions of address pulses and compensation pulses. The portion of the compensation pulses is designated by oblique lines. The address pulses are composed of two positive and negative pulses. The negative pulse is delayed by a half of one horizontal scanning period ($\frac{1}{2}$ $t_H$) from the positive pulse. The N-channel TFT $11_1$ is turned ON by the positive pulse, and the P-channel TFT $11_2$ is turned ON by the negative pulse. Therefore, the liquid crystal cell $LC_{m,2n-1}$ from $t_0$ to $t_1$, and the liquid crystal cell $LC_{m,2n}$ from $t_1$ to $t_2$. During the same duration, the compensation pulses are applied to the scan bus line $12_{m+1}$ of the downstream side. These compensation pulses are composed of a negative compensation pulse and positive compensation pulse. The negative compensation pulse applied from $t_0$ to $t_1$ cancels the DC component generated by the positive address pulse of the scan bus line $12_m$, the positive compensation pulse applied from $t_1$ to $t_2$ cancels the DC component generated by the negative address pulse of the scan bus line $12_m$. Therefore, the compensation pulses need to be added before the address pulses. The compensation pulses of the address signal $SC_m$ applied to the scan bus line $12_m$ cancel the DC components generated by address pulses of a scan bus line $12_{m-1}$.

However, TFTs are also turned ON by these compensation pulses. That is, the negative compensation pulse applied to the scan bus line $12_m$ turns the P-channel TFT $11_2$, and the positive compensation pulses applied to the scan bus line $12_m$ turns the N-channel TFT $11_1$. When the negative compensation pulse is applied to the scan bus line $12_m$ from $t_{-2}$ to $t_{-1}$, a data voltage charged to the liquid crystal cell $LC_{m-1,2n-1}$ is applied to the data bus line $13_n$. Therefore, the liquid crystal cell $LC_{m,2n}$ is charged to this voltage. This voltage of the liquid crystal cell $LC_{m,2n}$ is maintained until the TFT $11_2$ is turned ON again, i.e., $t_1$. Similarly, the liquid crystal cell $LC_{m,2n-1}$ is charged to a voltage of the liquid crystal cell $LC_{m-1,2n}$ from $t_{-1}$, to $t_0$, and is recharged from $t_0$ to $t_1$. FIGS. 12D and 12E show voltage variations owing to these operations.

The voltages temporarily charged by the compensation pulses have no relation to formal voltages. Therefore, the display contents of the liquid crystal cells are influenced by the display contents of the forward pixel rows. However, the durations in which informal voltages are charged are less than 3/2 $t_H$ at maximum. Active matrix-type liquid crystal display panels for a personal computer, etc. usually provide four hundred, or more pixel rows. Consequently, the ratio of the duration in which informal voltages are applied is less than 0.4% at maximum, and there is no problem in practical use.

Embodiments explained in the following are counter-matrix type devices according to the present invention.

Figure 13:
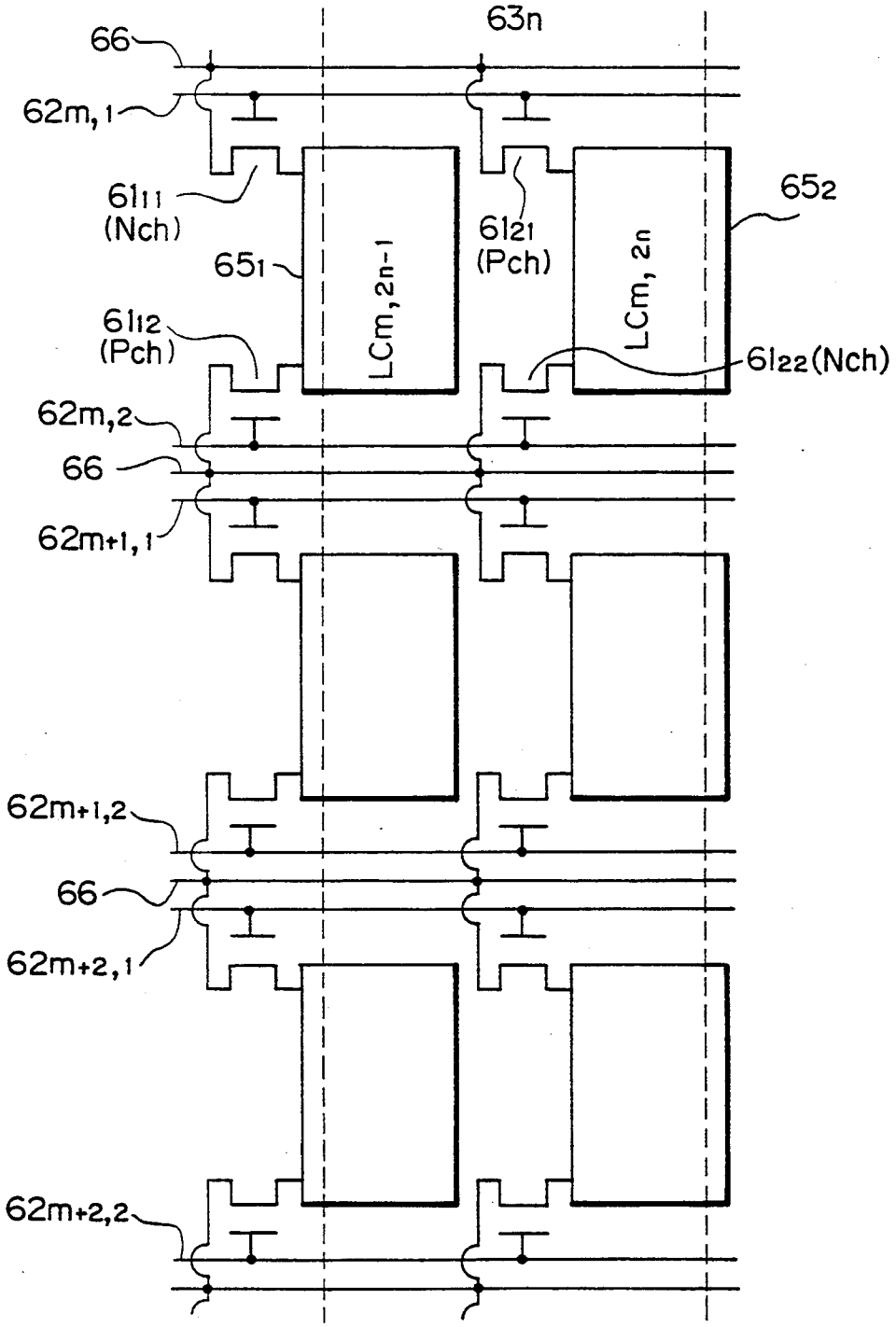
FIG. 13 is a circuit diagram illustrating a fourth embodiment of the active matrix-type liquid crystal display device according to the present invention.

FIG. 13 shows a circuit diagram of a fourth embodiment of the counter-matrix-type display device according to the present invention. This embodiment corresponds to the counter-matrix-type device of the first embodiment.

As shown in FIG. 13, the active matrix-type liquid crystal display device of this embodiment provides a plurality of pairs of scan bus lines $62_{m,1}$, $62_{m,2}$, $62_{m+1,1}$, $62_{m+1,2}$, . . . and a plurality of data bus lines $63_n$, . . . arranged perpendicularly to each other on different glass substrates having liquid crystal material filled therebetween. Also, pixel electrodes $65_1$, $65_2$, . . . are arranged within pixel areas in a matrix which partitioned by the scan bus lines and which face the data bus lines.

Further, reference voltage supply lines 66, which are in this case grounded GND, are arranged parallel with the scan bus lines $62_{m,1}$, $62_{m,2}$, $62_{m+1,1}$, $62_{m+1,2}$, . . . . These reference voltage supply lines are surrounded by two scan bus lines belonging to different pixel rows.

Liquid crystal cells $LC_{m,2n-1}$, $LC_{m,2n}$, . . . are formed by the pixel electrodes and the data bus lines with liquid crystal material.

In order to control each of the liquid crystal cells $LC_{m,2n-1}$, $LC_{m,2n}$, . . . , two kinds of thin film transistors (TFTs) $61_{11}$, $61_{12}$, $61_{21}$, $61_{22}$, i.e., an N-channel type TFT and a P-channel type TFT are provided for each liquid crystal cell. The N-channel type TFT is turned ON when a positive voltage is applied to its control gate, and the P-channel type TFT is turned ON when a negative voltage is applied to its control gate.

As shown in FIG. 13, two scan bus lines such as $62_{m,1}$ and $62_{m,2}$ are provided for each pixel row (a row of pixels arranged in horizontal direction in FIG. 13), and one line of the pair is arranged at the upper side of the pixel row and other line is arranged at the lower side of the pixel row. An N-channel type TFT and a P-channel type TFT are connected to each pixel electrode, and both TFTs are connected to the reference voltage supply lines. Further, two pixel electrodes are arranged to face the same data bus line. And, gates of an N-channel type TFT connected to the first pixel electrode of the pixel pair and a P-channel type TFT connected to the second side electrode of the pixel pair are connected to the upper scan bus line of the pair, and gates of a P-channel type TFT connected to the first electrode of the pixel pair and an N-channel type TFT connected to the second electrode of the pixel pair are connected to the lower side scan bus line of the pair. For example, as shown in FIG. 6, gates of an N-channel type TFT $11_{11}$ and P-channel type TFT $11_{21}$ are connected to the scan bus line $12_{m,1}$, and gates of a P-channel type TFT $11_{12}$ and an N-channel type TFT $11_{22}$ are connected to the scan bus line $12_{m,2}$.

By connecting TFTs in this way, two liquid crystal cells of the pixel pair can be independently controlled when two address pulses compensable to each other are applied to two scan bus lines corresponding to the pixel row.

In the device of the fourth embodiment, the same signals as illustrated in FIGS. 7A through 7G, 8A through 8G and 9A through 9F are available, and the same effects are obtained.

In the counter-matrix-type device, since the data bus lines operate as the counter pixel electrodes, potential fluctuations of the data bus lines influence the voltages of the liquid crystal cells via parasitic static capacitences. As shown in FIGS. 7E, 8E, the potentials of the data bus lines fluctuate twice those of the data voltages. Since the influences of the potential fluctuations of the data bus lines are proportioned to those amplitudes, the amplitudes of the potentials of the data bus lines are preferably small. In order to accomplish this, a device in which a potential of the reference voltage supply line is changed in synchronization with the data signal is proposed.

FIGS. 14A through 14E show the signals of the device of FIG. 13 in which the potential of the reference voltage supply lines 66 fluctuates.

Figures 14A, 14B, 14C, 14D, 14E:
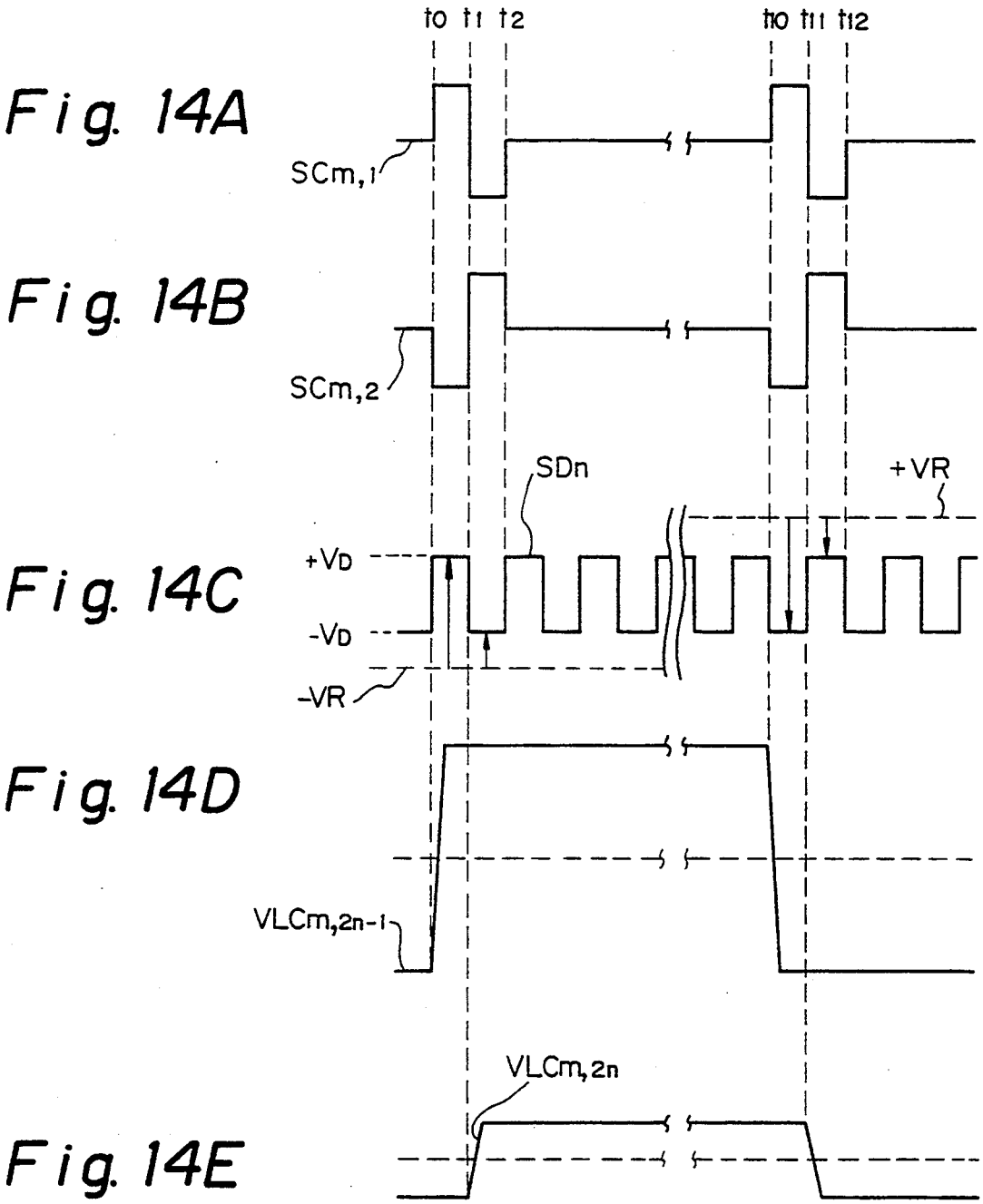
FIGS. 14A through 14E are timing diagrams showing the signals in the circuit of FIG. 13.
Figures 15A, 15B, 15C, 15D, 15E:
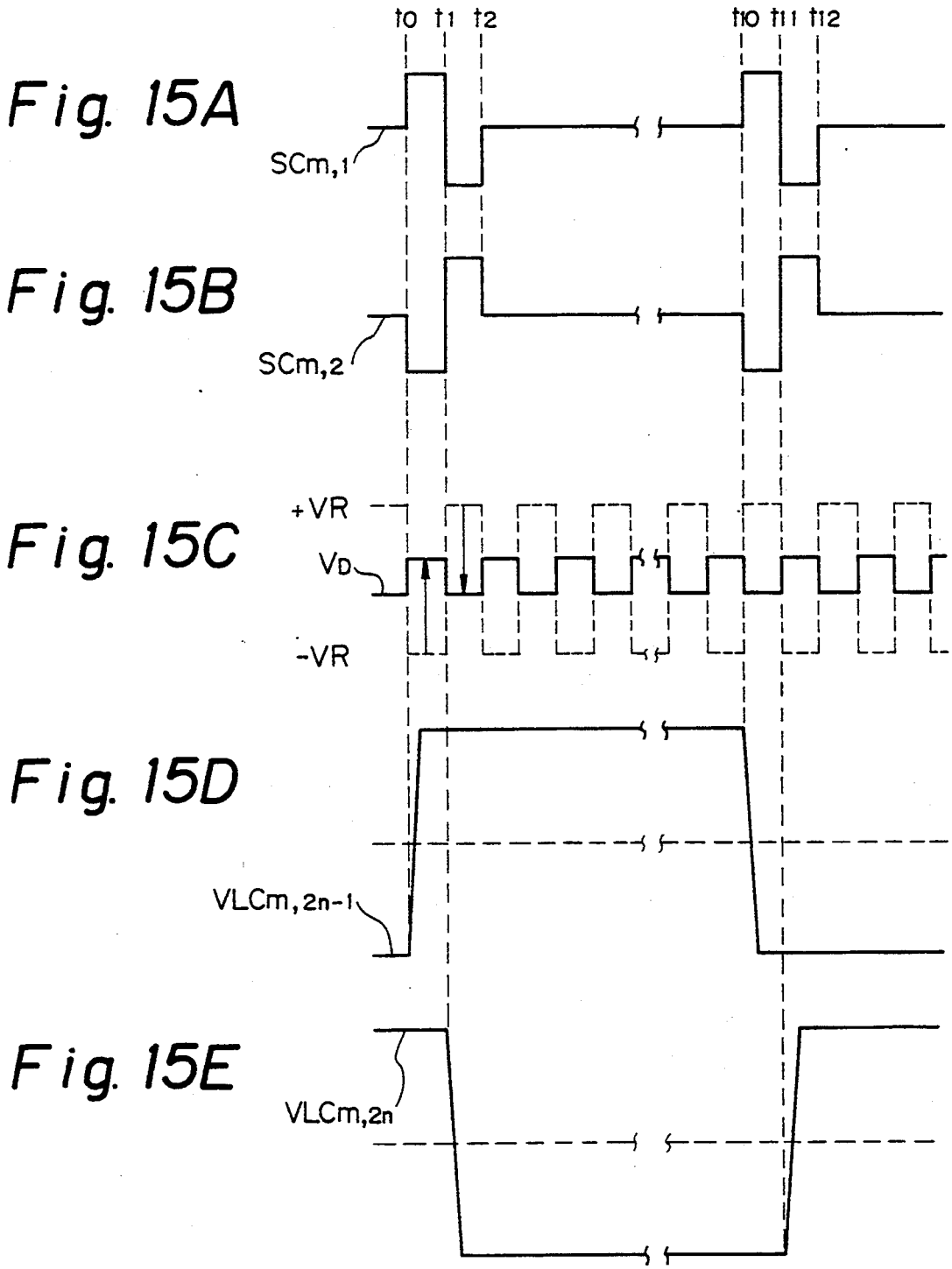
FIG. 15A through 15E are timing diagrams showing the signals in the circuit of FIG. 13.

As shown in FIGS. 14A and 14B, the same address signals $SC_{m,1}$, $SC_{m,2}$ of FIGS. 7A and 7B are respectively applied to the scan bus lines $62_{m,1}$ and $62_{m,2}$. In FIG. 14C, $SD_n$ designates the data signal, and −VR and +VR designate the levels of potentials of the reference voltage supply lines. In this case, the potential of the reference voltage supply lines changes in synchronization with a frame signal.

In the duration from $t_0$ to $t_1$, the liquid crystal cell $LC_{m,2n-1}$, is accessed. In this duration, the potential of the data bus line $63_n$ is +VD, and the potential of the reference voltage supply lines 66 is −VR. The difference between the potentials of the reference voltage supply lines 66 and the data bus line $63_n$ is charged to the liquid crystal cell $LC_{m,2n-1}$ $VLC_{m,2n-1}$, of FIG. 14D designates the potential of the liquid crystal cell $LC_{m,2n-1}$. In this duration, the liquid crystal cell $LC_{m,2n-1}$, is charged to (+VD+VR), which is a large positive value.

In the next duration from $t_1$ to $t_2$, which is delayed by a half of one horizontal scanning period, the liquid crystal cell $LC_{m,2n}$ is accessed. In this duration, the potential of the data bus line $63_n$ is −VD, and the potential of the reference voltage supply lines 66 is also −VR. The difference between the potentials of the reference voltage supply lines 66 and the data bus line $63_n$ is charged to the liquid crystal cell $LC_{m,2n}$. $VLC_{m,2n}$ of FIG. 14E designates the potential of the liquid crystal cell $LC_{m,2n}$. In this duration, the liquid crystal cell $LC_{m,2n}$ is charged to (−VD+VR), which is a small positive value.

After one frame cycle, in the duration from $t_{10}$ to $t_{11}$, the liquid crystal cell $LC_{m,2n-1}$ is accessed again. In this duration, the potential of the data bus line $63_n$ is −VD, and the potential of the reference voltage supply lines 66 is +VR. The difference between the potentials of the reference voltage supply lines 66 and the data bus line $63_n$ is charged to the liquid crystal cell $LC_{m,2-1}$. In this duration, the liquid crystal cell $LC_{m,2-1}$ is charged to (−VD−VR), which is a large negative value.

In the next duration from $t_{11}$ to $t_{12}$, which is delayed by a half of one horizontal scanning period, the liquid crystal cell $LC_{m,2n}$ is accessed. In this duration, the potential of the data bus line $63_n$ is +VD, and the potential of the reference voltage supply lines 66 is +VR. The difference between the potentials of the reference voltage supply lines 66 and the data bus line $63_n$ is charged to the liquid crystal cell $LC_{m,2n}$. In this duration, the liquid crystal cell $LC_{m,2n}$ is charged to (+VD−VR), which is a small negative value.

In this case, a lattice pattern of bright and dark lines are displayed by the data signal of FIG. 14C.

FIGS. 15A through 15E show another example of signals of the fourth embodiment in which the potential of the reference voltage supply lines 66 are changed. In this case, a bright monotone pattern is displayed. The potential of the reference voltage supply lines 66 is changed by a half of one scanning period ($\frac{1}{2}$ $t_H$). Since polarities of the voltages of the liquid crystal cells are decided by the direction from the potential of the reference to the potential of the data signal, in one frame, two neighboring cells are charged to different polarities.

Figure 16:
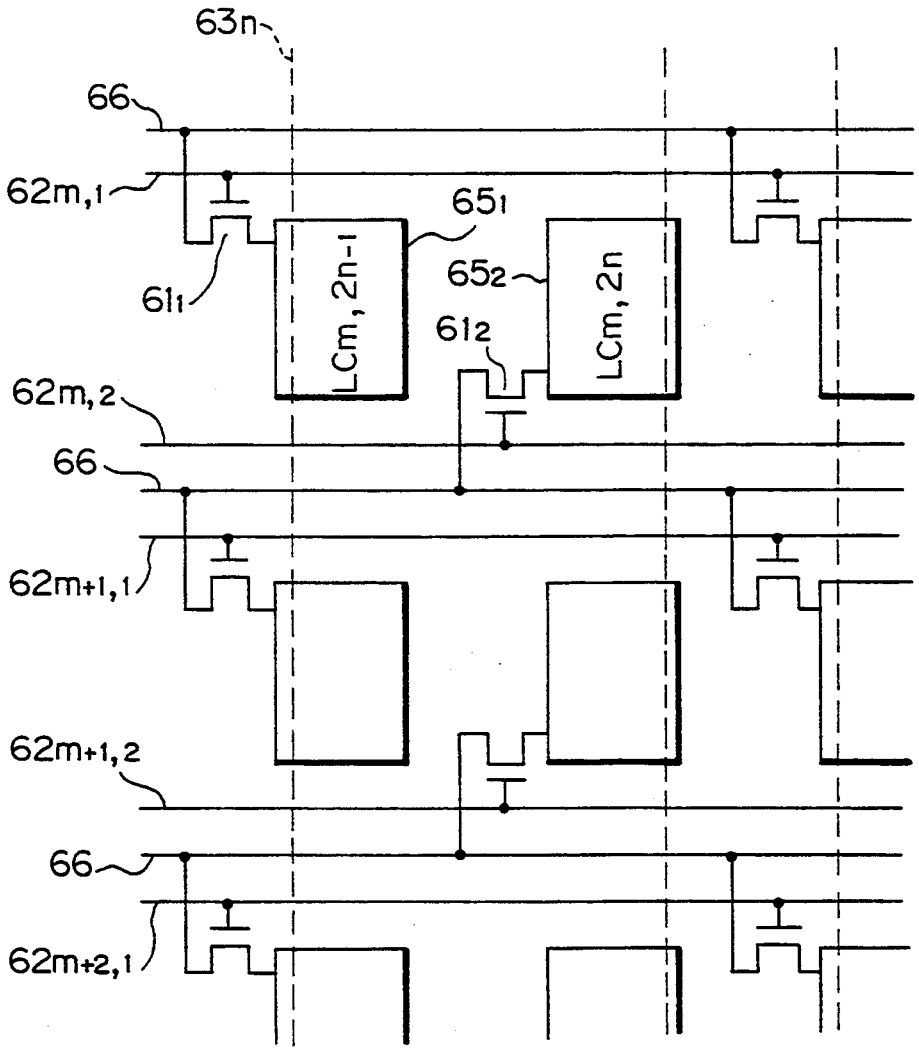
FIG. 16 is a circuit diagram illustrating a fifth embodiment of the active matrix-type liquid crystal display device according to the present invention.

FIG. 16 shows a circuit diagram of a fifth embodiment, that corresponds to the counter-matrix-type device of the second embodiment, excepting auxiliary lines.

As shown in FIG. 16, the active matrix-type liquid crystal display device of this embodiment provides a plurality of pairs of scan bus lines $62_{m,1}$, $62_{m,2}$, $62_{m+1,1}$, $62_{m+1,2}$, . . . and a plurality of data bus lines $63_n$, . . . arranged perpendicularly to each other on different glass substrates having liquid crystal material filled therebetween. Also, pixel electrodes $65_1$, $65_2$, . . . are arranged within pixel areas in a matrix which are partitioned by the scan bus lines and which face the data bus lines.

Further, reference voltage supply lines 66, which are in this case grounded GND, are arranged parallel with the scan bus lines $62_{m,1}$, $62_{m,2}$, $62_{m+1,1}$, $62_{m+1,2}$, . . . . Each of reference voltage supply lines are surrounded by two scan bus lines belonging to different pixel rows.

Liquid crystal cells $LC_{m,2n-1}$, $LC_{m,2n}$, . . . are formed by the pixel electrodes and the data bus lines with liquid crystal material.

In order to control each of the liquid crystal cells $LC_{m,2n-1}$, $LC_{m,2n}$, . . . , thin film transistors (TFTs) $61_1$, $61_2$ are provided for each liquid crystal cell, and these TFTs operate by signals having the same polarity. In this embodiment, all TFTs are the N-channel type.

Two scan bus lines $62_{m,1}$, $62_{m,2}$ are provided for each pixel row, and one scan bus line $62_{m,1}$ is at the upper side of the pixel row, and the other scan bus line $62_{m,2}$ is at the lower side of the pixel row. Two liquid crystal cells $LC_{m,2n-1}$, $LC_{m,2n}$ make a pair, and two pixel electrodes $65_1$, $65_2$ of the pair of the liquid crystal cells are connected to the reference voltage supply bus line $66_n$ via TFT $61_1$ and TFT $61_2$. A control gate of the TFT $61_1$ is connected to the scan bus line $62_{m,1}$, and a control gate of the TFT $61_2$ is connected to the scan bus line $62_{m,2}$.

In the device of the fifth embodiment, the same signals as illustrated in FIGS. 7A through 7G, 8A through 8G, 14A through 14E, and 15A through 15E are available, and the same effects as in the second embodiment are obtained.

Figure 17:
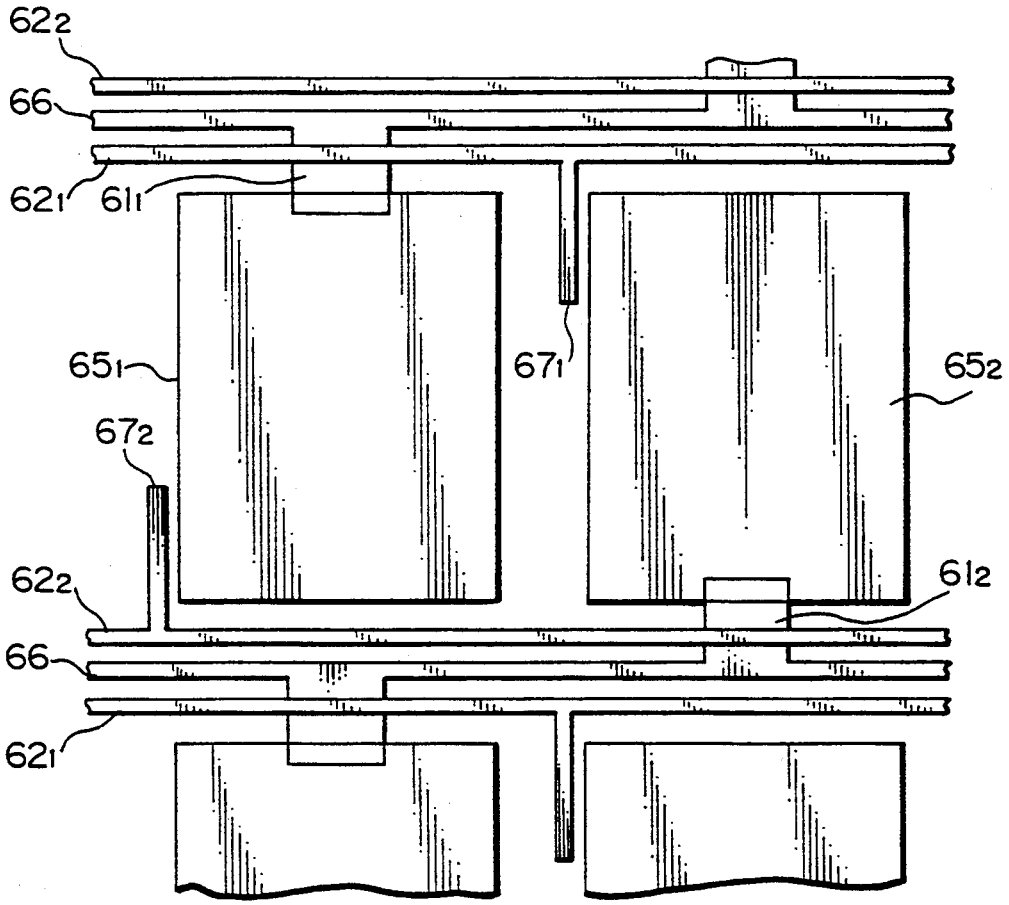
FIG. 17 is a layout diagram of the device of FIG. 16.

The device of the second embodiment provides auxiliary lines elongated from the scan bus lines to the pixel electrodes. The device of the fifth embodiment can also provide auxiliary lines. FIG. 17 shows an example of auxiliary lines $67_1$, $67_2$ in the device of the fifth embodiment. The auxiliary line $67_1$ elongates from the upper side scan bus line $12_{m,1}$ to the pixel electrode $65_2$, and the auxiliary line $67_2$ elongates from the lower side scan bus line $12_{m,2}$ to the pixel electrode $15_1$.

It is already described that, in a counter-matrix-type device, the potential of the reference voltage supply lines can be fluctuated for reducing the influences of the potential fluctuations of the data bus lines. FIGS 14A through 14E and 15A through 15E show the operations when the potential of the reference voltage supply lines fluctuates. However, this voltage fluctuation of the reference voltage supply lines also influences display conditions of the liquid crystal cells. In the following embodiment, this problem will be dissolved.

Figure 18:
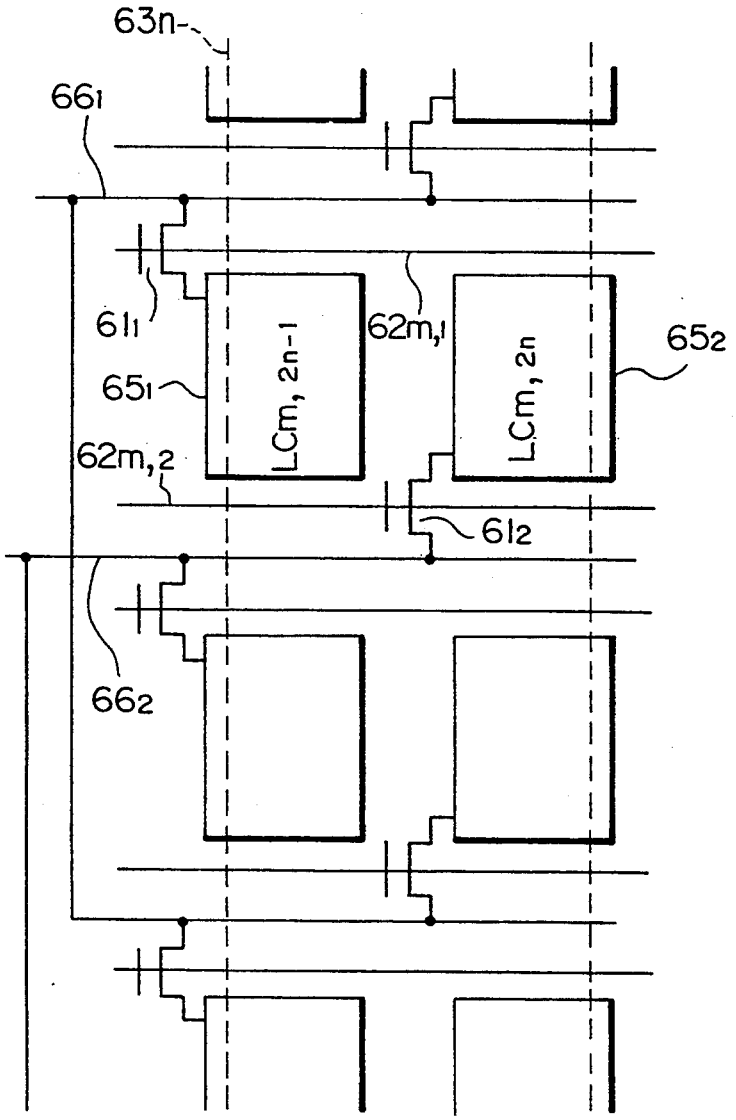
FIG. 18 is a circuit diagram illustrating a sixth embodiment of the active matrix-type liquid crystal display device according to the present invention.

In FIG. 18, which is a sixth embodiment of the counter-matrix-type display device according to the present invention, the device of FIG. 16 is modified. That is, the reference voltage supply lines 66 are alternately divided into two kinds of lines $66_1$ and $66_2$. Reference voltage supply lines including each kind are connected at their ends and two different voltage signals are respectively applied.

FIGS. 19A through 19G show address signals $SC_{m,1}$ applied to the scan bus lines $62_{m,1}$, a data signal $SD_n$ applied to the data bus line $63_n$, potential signals VR1, VR2 applied to the reference voltage supply lines $66_1$, $66_2$, and the voltages $VLC_{m,2n-1}$, $VLC_{m,2n}$ of the liquid crystal cells $LC_{m,2n-1}$, $LC_{m,2n}$ of FIG. 18.

Figures 19A, 19B, 19C, 19D, 19E, 19F, 19G:
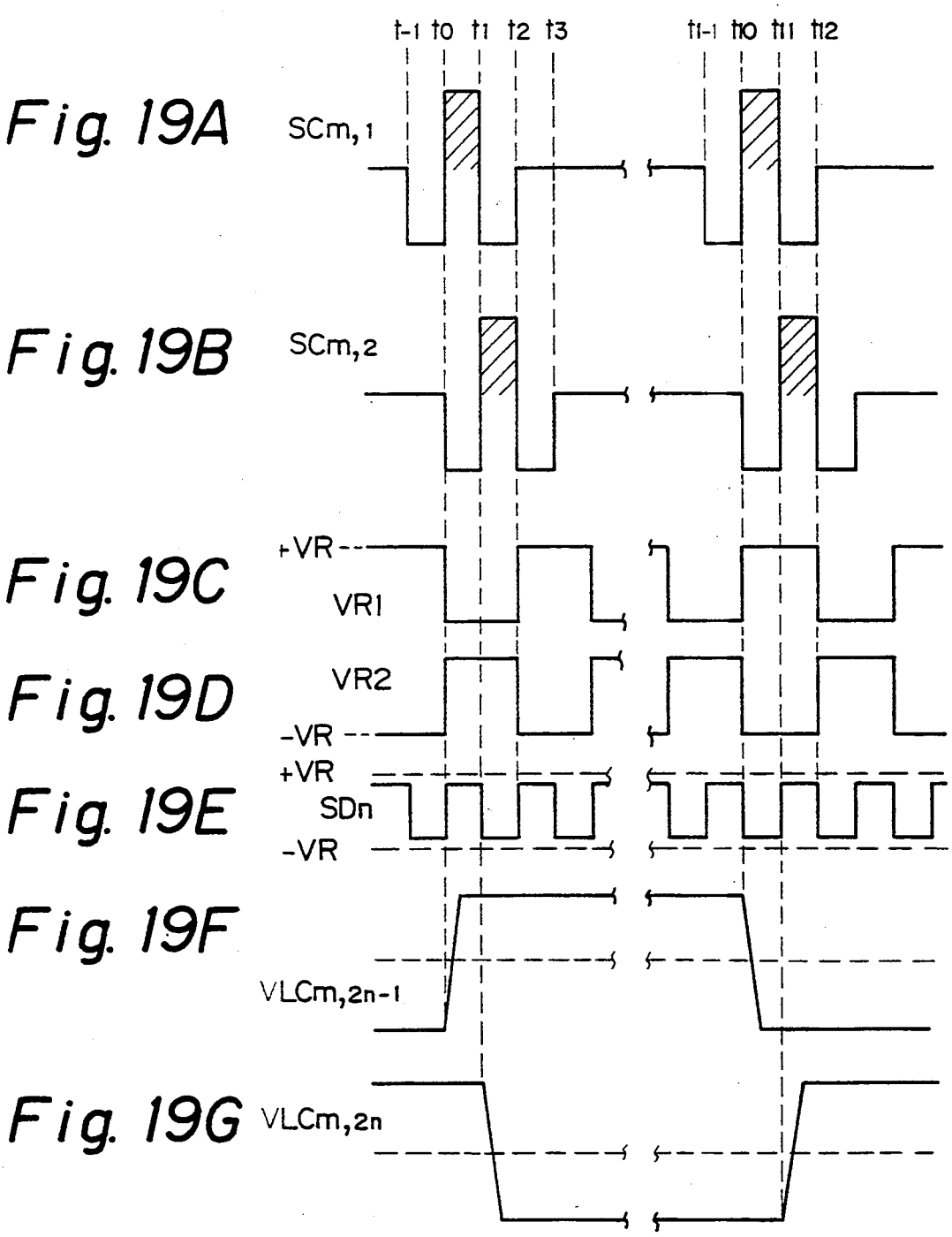
FIGS. 19A through 19G are timing diagrams showing the signals in the circuit of FIG. 18.

The address signal $SC_{m,1}$, $SC_{m,2}$ of FIGS. 19A and 19B are the signals of FIGS. 7A and 7B to which extra compensation pulses are added. The negative pulse of the address signal $SC_{m,1}$ from $t_{-1}$, to $t_0$ and the negative pulse of the address pulse $SC_{m,2}$ from $t_2$ to $t_3$ correspond to these extra compensation pulses. From $t_{-1}$, to $t_0$, the pixel row including the liquid crystal cells $LC_{m,2n-1}$, $LC_{m,2n}$ is not accessed, but the adjacent pixel row at upper side of this pixel row is accessed. Therefore, the positive address pulses are applied to the lower side scan bus line of this upper side pixel row, and this extra compensation pulse of the signal $SC_{m,1}$ compensates this address pulse. Of course, at this time, the compensation pulse is applied to the upper side scan bus line of this upper side pixel row, and this compensation pulse and the extra compensation pulse jointly compensate for the address pulse. Similarly, the extra compensation pulse of the signal $SC_{m,2}$ compensates for the address pulse applied to the scan bus line of the lower side pixel row. Thereby, the amplitude of each compensation pulse can be reduced. These extra compensation pulses can be available in the second and fifth embodiments.

Further, as shown in FIGS. 19C and 19D, the voltage signals VR1 and VR2 applied to the reference voltage supply lines $66_1$ and $66_2$ are in synchronization and have opposite polarity. When the data signal applied to the data bus line $63_n$, the voltages $VLC_{m,2n-1}$, $VLC_{m,2n}$ of the liquid crystal cells $LC_{m,2n-1}$, $LC_{m,2n}$ change as in FIGS. 19F and 19G, and since the potentials of the reference voltage supply lines fluctuate as in FIGS. 19C and 19D, the influences of these fluctuations can be reduced.

Figure 20:
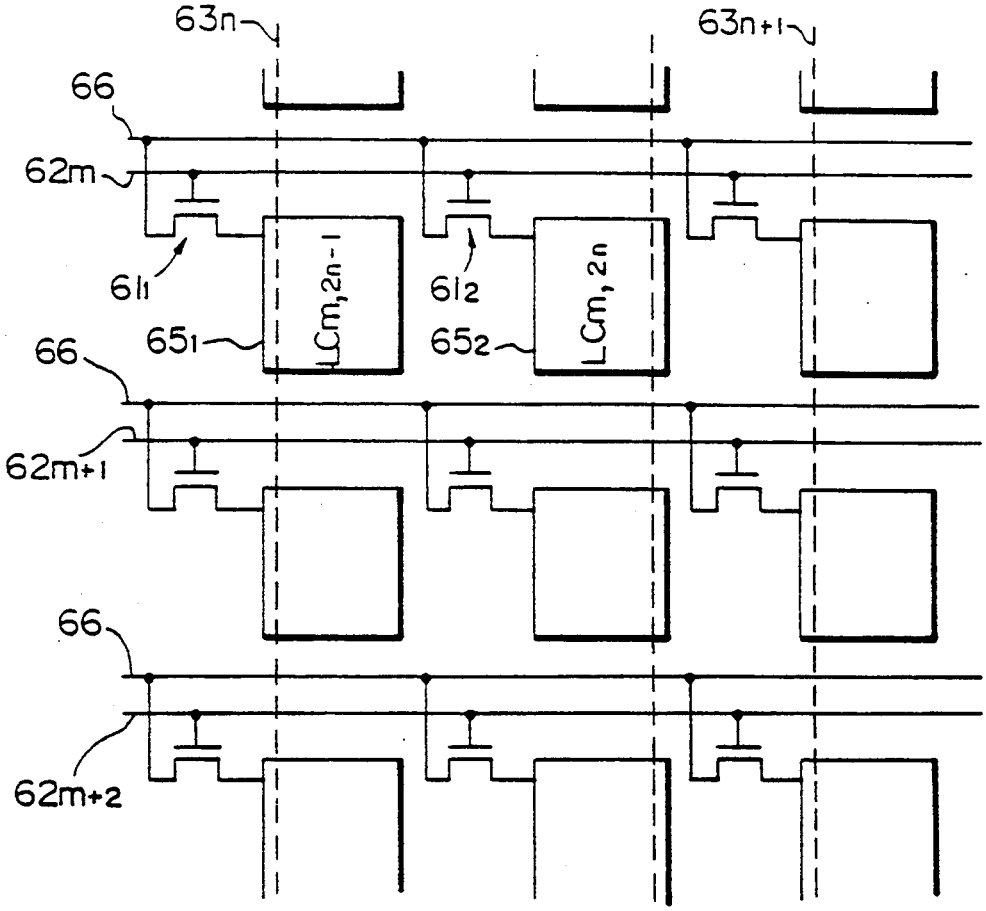
FIG. 20 is a circuit diagram illustrating a seventh embodiment of the active matrix-type liquid crystal display device according to the present invention.

FIG. 20 shows a circuit diagram of a seventh embodiment of the counter-matrix-type display device according to the present invention. This embodiment corresponds to the counter-matrix-type device of the third embodiment, and this circuit is same to that disclosed in a figure of the Japanese Unexamined Patent Publication No. 2-2135318.

As shown in FIG. 20, the active matrix-type liquid crystal display device of this embodiment provides a plurality of scan bus lines $62_m$, $62_{m+1}$, . . . and a plurality of data bus lines $63_n$, . . . arranged perpendicularly to each other on different glass substrates having liquid crystal material filled therebetween. Also, pixel electrodes $65_1$, $65_2$, . . . are arranged within pixel areas in a matrix which are partitioned by the scan bus lines and which face the data bus lines . Further, reference voltage supply lines 66 are arranged parallel with the scan bus lines.

Liquid crystal cells $LC_{m,2n-1}$, $LC_{m,2n}$, . . . are formed by the pixel electrodes and the data bus lines with liquid crystal material.

In order to control each of the liquid crystal cells $LC_{m,2n-1}$, $LC_{m,2n}$, . . . , there are two kinds of thin film transistors (TFTs) $61_1$, $61_2$, . . . . In this embodiment, the TFTs are composed of N-channel type TFTs and P-channel type TFTs. For example, the TFT $61_1$ is an N-channel type TFT, and the TFT $61_2$ is a P-channel type TFT.

One scan bus line 622 is provided for each pixel row, and this scan bus line $62_m$ is arranged at the upstream side of the pixel row of the scanning direction. Two liquid crystal cells $LC_{m,2n-1}$, $LC_{m,2n}$ make a pair, and two pixel electrodes $65_1$, $65_2$ of the pair of the liquid crystal cells are arranged so as to face to the same data bus line $63_n$. Both control gates of the TFTs $61_1$, $61_2$ are connected to the scan bus line $62_m$.

In the device of the seventh embodiment, the same signals as illustrated in FIGS. 12A through 12C are available, and the same effects are obtained.

In the above-mentioned embodiments, liquid crystal material is used as an electro-optic element, however, an electroluminescence element, an electrochromic element, and the like can also be used. Various configurations, shape, material, and the like can be used for the above-mentioned active-type liquid crystal panel.

As described above, according to the present invention, in the device in which the number of data bus lines is reduced, the shift voltage owing to the various parasitic electrostatic capacities can be compensated for by a simple construction.

We claim:

1. An active matrix-type display device, comprising:

first and second insulating substrates arranged parallel to each other and having electro-optic material filled therebetween;

reference voltage supply electrodes formed on said second insulating substrate;

a plurality of pairs of first and second scan bus lines in parallel formation on said first insulating substrate;

a plurality of data bus lines in parallel formation on said first insulating substrate, said data bus lines being perpendicular to said scan bus lines;

a plurality of pixel electrodes in a matrix formed on said first insulating substrate at intersections of said first and second scan bus lines and said data bus lines;

a plurality of first switching elements, each connected between one of said pixel electrodes and one of said data bus lines; said first switching elements being controlled by a potential at one of said scan bus lines and being turned ON when said potential is positive;

a plurality of second switching elements, each connected between one of said pixel electrodes and one of said data bus lines; said second switching elements being controlled by a potential at one of said scan bus lines and being turned ON when said potential is negative;

a pair of said first and second scan bus lines being provided for each row of said pixel electrodes, and two scan bus lines of said pair being arranged on each sides of said row;

a pair of said first switching element and said second switching element being connected to each of said pixel electrodes;

each pair of said pixel electrodes neighboring in the direction of said scan bus lines being connected to one and the same of said data bus lines via said first and second switching elements; and control gates of a first switching element connected to one of said pair of said pixel electrodes and a second switching element connected to the other of said pair of said pixel electrodes being connected to one of said pair of said scan bus lines, and control gates of a second switching element connected to one of said pair of said pixel electrodes and a first switching element connected to the other of said pair of said pixel electrodes being connected to the other of said pair of said scan bus lines.

2. An active matrix-type display device as set forth in claim 1, wherein two address pulses having opposite polarity are simultaneously applied to said pair of said scan bus lines.

3. An active matrix-type display device as set forth in claim 1, wherein address pulses applied to said pair of said scan bus lines have pulse widths less than a half of a horizontal scanning duration, and said address pulses mutually turn to reverse polarity and a sequence order is replaced between said pair of said scan bus lines.

4. An active matrix-type display device, comprising:

first and second insulating substrates arranged parallel to each other and having electro-optic material filled therebetween;

reference voltage supply electrodes formed on said second insulating substrate;

a plurality of pairs of first and second scan bus lines in parallel formation on said first insulating substrate;

a plurality of data bus lines in parallel formation on said first insulating substrate, said data bus lines being perpendicular to said scan bus lines;

a plurality of pixel electrodes in a matrix formed on said first insulating substrate at intersections of said first and second scan lines and said data bus lines;

a plurality of switching elements each connected between one of said pixel electrodes and one of said data bus lines; said switching elements being controlled by the same polar pulse at one of said scan bus lines;

a pair of said first and second scan bus lines being provided for each row of said display electrodes;

each pair of said pixel electrodes neighboring in the direction of said scan bus lines being connected to one and the same of said data bus lines via respective switching elements;

control gates of switching elements connected to said pair of pixel electrodes being respectively connected to each line of said pair of scan bus lines; and a compensation pulse which has a polarity opposite to that of an address pulse being simultaneously applied to one scan bus line of said pair when said address pulse is applied to the other scan bus line of said pair.

5. An active matrix-type display device as set forth in claim 4; said first and second scan bus lines have portions elongated to and along said pixel electrodes.

6. An active matrix-type display device, comprising:

first and second insulating substrates arranged parallel to each other and having electro-optic material filled therebetween;

reference voltage supply electrodes formed on said second insulating substrate;

a plurality of scan bus lines in parallel formation on said first insulating substrate;

a plurality of data bus lines in parallel formation on said first insulating substrate, said data bus lines being perpendicular to said scan bus lines;

a plurality of pixel electrodes in a matrix formed on said first insulating substrate at intersections of said first and second scan bus lines and said data bus lines;

a plurality of first switching elements, each connected between one of said pixel electrodes and one of said data bus lines; said first switching elements being controlled by a potential at one of said scan bus lines and being turned ON when said potential is positive;

a plurality of second switching elements, each connected between one of said pixel electrodes and one of said data bus lines; said second switching elements being controlled by a potential at one of said scan bus lines and being turned ON when said potential is negative;

one of said scan bus lines being provided for each row of said display electrodes at the upstream side of the scanning direction;

one of said first switching elements being connected to one of each pair of said pixel electrodes neighboring in a direction of said scan bus lines, and one of said second switching elements being connected to the other of said pair of said pixel electrodes, and control gates of switching elements connected to pixel electrodes in the same row being connected to the same scan bus line;

said pair of said pixel electrodes being connected to one and the same of said data bus lines via respective switching elements; and an address pulse composed of two pulses that have pulse widths less than a half of a horizontal scanning duration and are shifted to each other by a half of a horizontal scanning duration being applied to said scan bus lines, and a compensation pulse composed of inverted pulses of said address pulse being applied to the next downstream side scan bus line.

7. An active matrix-type display device as set forth in claim 6; said first and second scan bus lines have portions elongated to and along said pixel electrodes.

8. An active matrix-type display device, comprising:

first and second insulating substrates arranged parallel to each other and having electro-optic material filled therebetween;

a plurality of pairs of first and second scan bus lines in parallel formation on said first insulating substrate;

a plurality of data bus lines in parallel formation on said second insulating substrate; said data bus lines being perpendicular to said scan bus lines;

a plurality of pixel electrodes in a matrix formed on said first insulating substrate; said pixel electrodes being within pixel areas and facing said data bus lines;

a plurality of reference voltage supply lines in parallel formation on said first insulating substrate;

a plurality of first switching elements, each connected between one of said pixel electrodes and one of said reference voltage supply lines, said first switching elements being controlled by a potential at one of said scan bus lines and being turned ON when said potential is positive;

a plurality of second switching elements, each connected between one of said pixel electrodes and one of said reference voltage supply lines, said second switching elements being controlled by a potential at one of said scan bus lines and being turned ON when said potential is negative;

a pair of said first and second scan bus lines being provided for each row of said display electrodes, and two scan bus lines of said pair being arranged on each side of said row;

a pair of said first switching elements and said second switching elements being connected to each of said pixel electrodes;

each pair of said pixel electrodes neighboring in a direction of said scan bus lines being arranged to face said data bus lines; and a first switching element connected to one of said pair of said pixel electrodes and a second switching element connected to the other of said pair of said pixel electrodes being connected to one of said pair of said scan bus lines, and a second switching elements connected to one of said pair of said pixel electrodes and a first switching element connected to another of said pair of said pixel electrodes being connected to another of said pair of said scan bus lines.

9. An active matrix-type display device as set forth in claim 8, wherein two address pulses having opposite polarity are simultaneously applied to said pair of said scan bus lines.

10. An active matrix-type display device as set forth in claim 8, wherein address pulses applied to said pair of said scan bus lines have pulse widths less than a half of a horizontal scanning duration, and said address pulses mutually turn to reverse polarity and a sequence order is replaced between said pair of said scan bus lines.

11. An active matrix-type display device, comprising:

first and second insulating substrates arranged parallel to each other and having electro-optic material filled therebetween;

a plurality of pairs of first and second scan bus lines in parallel formation on said first insulating substrate, said first and second scan bus lines being perpendicular to said data bus lines;

a plurality of data bus lines in parallel formation on said second insulating substrate, said data bus lines being perpendicular to said scan bus lines;

a plurality of pixel electrodes in a matrix formed on said first insulating substrate; said pixel electrodes being within pixel areas and facing said data bus lines;

a plurality of reference voltage supply lines in parallel formation on said first insulating substrate;

a plurality of switching elements, each connected between one of said pixel electrodes and one of said reference voltage supply lines, said switching elements being controlled by the same polar pulse at one of said scan bus lines;

a pair of said first and second scan bus lines being provided for each row of said pixel electrodes, and two scan bus lines of said pair being arranged on each side of said row;

each pair of said pixel electrodes neighboring in a direction of said scan bus lines being arranged to face said data bus lines; and control gates of switching elements connected to said pair of said pixel electrodes being respectively connected to each line of said pair of said scan bus lines.

12. An active matrix-type display device as set forth in claim 11; said first and second scan bus lines have portions elongated to and along said pixel electrodes.

13. An active matrix-type display device as set forth in claim 11, wherein a compensation pulse which has a polarity opposite to that of an address pulse being simultaneously applied to one scan bus line of said pair when said address pulse is applied to the other scan bus line of said pair.

14. An active matrix-type display device as set forth in claim 11, wherein said reference voltage supply lines are composed of two kinds of reference voltage supply lines alternately arranged for every row of pixel electrodes.

15. An active matrix-type display device as set forth in claim 14, wherein two reference voltage signals that are in synchronization with each other and have opposite polarities are respectively applied to said two reference voltage supply lines.

16. An active matrix-type display device as set forth in claim 14; said first and second scan bus lines have portions elongated to and along said pixel electrodes.

17. An active matrix-type display device as set forth in claim 14, wherein a compensation pulse which has a polarity opposite to that of an address pulse being simultaneously applied to one scan bus line of said pair when said address pulse is applied to the other scan bus line of said pair.

18. An active matrix-type display device as set forth in claim 17, wherein extra compensation pulses which have polarities opposite to those of an address pulse being further simultaneously applied to scan bus lines corresponding to other rows of said pixel electrodes when said address pulse is applied.

19. An active matrix-type display device, comprising:

first and second insulating substrates arranged parallel to each other and having electro-optic material filled therebetween;

a plurality of scan bus lines in parallel formation on said first insulating substrate;

a plurality of data bus lines in parallel formation on said second insulating substrate, said data bus lines being perpendicular to said scan bus lines;

a plurality of pixel electrodes in a matrix formed on said first insulating substrate; said pixel electrodes being within pixel areas and facing said data bus lines;

a plurality of reference voltage supply lines in parallel formation on said first insulating substrate;

a plurality of first switching elements, each connected between one of said pixel electrodes and one of said reference voltage supply lines; said first switching elements being controlled by a potential at one of said scan bus lines and being turned ON when said potential is positive;

a plurality of second switching elements, each connected between one of said pixel electrodes and one of said reference voltage supply lines; said second switching elements being controlled by a potential at one of said scan bus lines and being turned ON when said potential is negative;

one of said scan bus lines being provided for each row of said display electrodes at an upstream side of scanning direction;

each pair of said pixel electrodes neighboring in a direction of said scan bus lines being arranged to face said data bus lines;

one of said first switching elements being connected to one of said pair of said pixel electrodes, and one of said second switching elements being connected to the other of said pair of said pixel electrodes, and switching elements connected to pixel electrodes in the same row being connected to the same scan bus line; and an address signal composed of two pulses that have pulse widths less than a half of a horizontal scanning period and are shifted to each other by a half of a horizontal scanning duration being applied to said scan bus lines, and a compensation pulse composed of inverted pulses of said address pulse being applied to the next downstream side scan bus line.

20. An active matrix-type display device as set forth in claim 19; said first and second scan bus lines have portions elongated to and along said pixel electrodes.

21. An active matrix-type display device, comprising:

first and second insulating substrates arranged parallel to each other and having electro-optic material filled therebetween;

a plurality of pairs of first and second scan bus lines in parallel formation on said first insulating substrate;

a plurality of data bus lines in parallel formation on said second insulating substrate; said data bus lines being perpendicular to said scan bus lines;

a plurality of pixel electrodes in a matrix formed on said first insulating substrate; said pixel electrodes being within pixel areas and facing said data bus lines;

a plurality of reference voltage supply lines in parallel formation on said first insulating substrate;

a plurality of first switching elements, each connected between one of said pixel electrodes and one of said reference voltage supply lines, said first switching elements being controlled by a potential at one of said scan bus lines and being turned ON when said potential is positive;

a plurality of second switching elements, each connected between one of said pixel electrodes and one of said reference voltage supply lines, said second switching elements being controlled by a potential at one of said scan bus lines and being turned ON when said potential is negative;

a pair of said first and second scan bus lines being provided for each row of said display electrodes, and two scan bus lines of said pair being arranged on each side of said row;

a pair of said first switching elements and said second switching elements being connected to each of said pixel electrodes; and each pair of said pixel electrodes neighboring in a direction of said scan bus lines being arranged to face said data bus lines.

* * * * *

UNITED STATES PATENT AND TRADEMARK OFFICE

CERTIFICATE OF CORRECTION

PATENT NO. : 5,408,252

DATED : April 18, 1995

INVENTOR(S) : Ken-ichi OKI et al.

It is certified that error appears in the above-indentified patent and that said Letters Patent is hereby corrected as shown below:

Column 1, line 67, change "capacitense" to --capacitance--.

Column 2, line 26, change "2-212819" to --2-214819--.

Column 3, line 54, after "parallel" insert --to each other--.

Column 4, line 20, change "212" to --214--.

Column 5, line 51, change "capacitense" to --capacitance--.

UNITED STATES PATENT AND TRADEMARK OFFICE

CERTIFICATE OF CORRECTION

PATENT NO. : 5,408,252 Page 2 of 4

DATED : April 18, 1995

INVENTOR(S) : Ken-ichi OKI et al.

It is certified that error appears in the above-indentified patent and that said Letters Patent is hereby corrected as shown below:

Column 6, lines 1, 4, 6 and 8, change "capacitense" to --capacitance--;

line 11, change "$V_{ic}$" to --$V_{1c}$--;

line 14, change "$V_{ic}$" to --$V_{1c}$--; and change "$C_{ic}$" to --$C_{1c}$--;

line 33, change "$V_{ic}$" to --$V_{1c}$--.

Column 7, line 15, change "212" to --214--.

Column 8, line 23, change "And" to --AND--.

UNITED STATES PATENT AND TRADEMARK OFFICE

CERTIFICATE OF CORRECTION

PATENT NO. : 5,408,252

DATED : April 18, 1995

INVENTOR(S) : Ken-ichi OKI et al.

It is certified that error appears in the above-indentified patent and that said Letters Patent is hereby corrected as shown below:

Column 9, line 13, change "$11_{22}$" to --$11_{12}$--;

line 37, change "to" to --$t_0$--; and change "$t_0$" to --$t_2$--.

Column 13, lines 17 and 20, change "capacitence" to --capacitance--;

line 23, change "capacity" to --capacitance--;

line 46, delete "parallel".

Column 15, lines 59 and 60, change "capacitences" to --capacitances--.

UNITED STATES PATENT AND TRADEMARK OFFICE

CERTIFICATE OF CORRECTION

PATENT NO. : 5,408,252 Page 4 of 4

DATED : April 18, 1995

INVENTOR(S) : Ken-ichi OKI et al.

It is certified that error appears in the above-indentified patent and that said Letters Patent is hereby corrected as shown below:

Column 16, line 15, change "_VR." to ---VR.--;

line 41, change "$LC_{m,2-1}$" to --$LC_{m,2n-1}$--;

line 42, change "$LC_{m,2-1}$" to --$LC_{m,2n-1}$--.

Column 18, line 67, change "622" to --$62_m$--.

Column 24, line 16, change "19;" to --19,--.

Signed and Sealed this

Eighth Day of August, 1995

*Attest:*

*Attesting Officer*

BRUCE LEHMAN

*Commissioner of Patents and Trademarks*